US005528129A

United States Patent [19]

Kaneko et al.

[11] Patent Number: 5,528,129

[45] Date of Patent: Jun. 18, 1996

[54] SEMICONDUCTOR INTEGRATED CIRCUIT FOR GENERATING CONSTANT INTERNAL VOLTAGE

[75] Inventors: Tetsuya Kaneko, Kawaguchi; Takashi Ohsawa, Yokohama, both of Japan

[73] Assignee: Kabushiki Kaisha Toshiba, Kawasaki, Japan

[21] Appl. No.: 94,346

[22] Filed: Jul. 21, 1993

[30] Foreign Application Priority Data

Jul. 23, 1992 [JP] Japan ..... 4-196940

[51] Int. Cl.[6] ..... G05F 3/16

[52] U.S. Cl. ..... 323/313

[58] Field of Search ..... 323/281, 312, 323/313, 314; 307/296.1, 296.3, 296.6; 365/226, 227; 327/530, 534–536, 538–540

[56] References Cited

U.S. PATENT DOCUMENTS

| | | | |
|---|---|---|---|
| 4,890,051 | 12/1989 | Kim et al. | 323/313 |
| 5,146,152 | 9/1992 | Jin et al. | 323/281 |
| 5,153,855 | 10/1992 | Konishi | 365/226 |
| 5,187,397 | 2/1993 | Nishimori et al. | 307/570 |
| 5,289,111 | 2/1994 | Tsuji | 323/313 |
| 5,307,315 | 4/1994 | Oowaki et al. | 307/296.6 |
| 5,376,839 | 12/1994 | Horiguchi et al. | 327/541 |
| 5,398,207 | 3/1995 | Tsuchida et al. | 365/226 |

*Primary Examiner*—Mattew V. Nguyen
*Attorney, Agent, or Firm*—Banner & Allegretti, Ltd.

[57] ABSTRACT

A semiconductor integrated circuit has a function of providing an internal voltage having little dependency on a variation of external power supply voltage comprises a reference voltage generating circuit which outputs a first output corresponding to a reference voltage, a voltage converting circuit which outputs a second output, a level of which is in accordance with an outer power source voltage, a voltage-decrease/boosting selecting circuit which receives first and second outputs and outputs a third output resulting from comparing a level of the first output with a level of the second output, a level of the third output being changed when a level of the outer power source voltage exceeds a prescribed value. Also included are a voltage-decrease circuit which decreases the outer power source voltage upon receiving the third output and outputs an internal voltage when the third output has a first level, a boosting circuit which constantly boosts the outer power source voltage upon receiving the third output and outputs the internal voltage when the third output has a second level, an internal voltage limiting circuit which outputs a fourth output upon receiving the first output and the internal voltage to control a decreasing amount of the voltage-decrease circuit and a boosting amount of the boosting circuit, and an internal circuit for receiving the internal voltage.

76 Claims, 9 Drawing Sheets

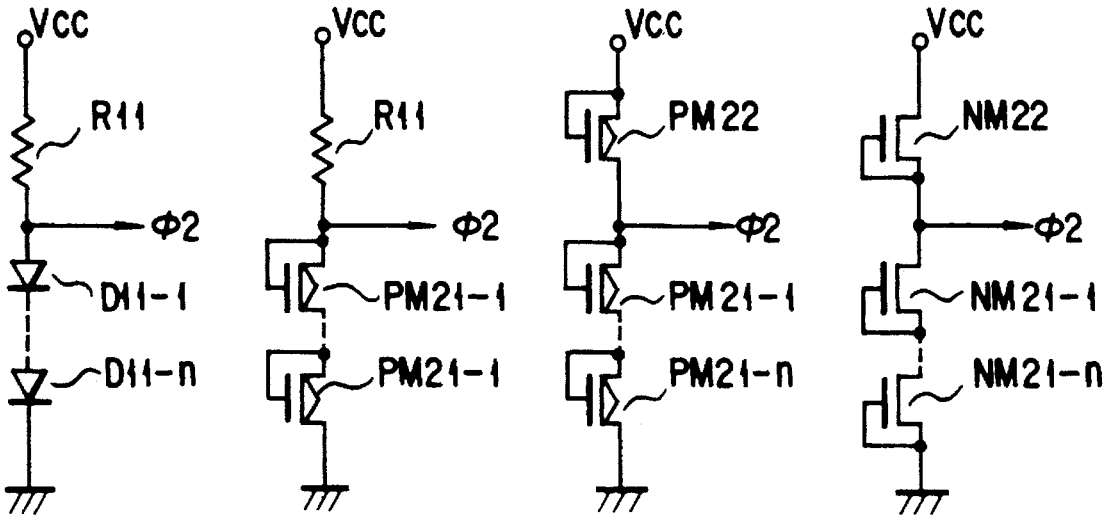
FIG. 6A FIG. 6C
FIG. 6B FIG. 6D
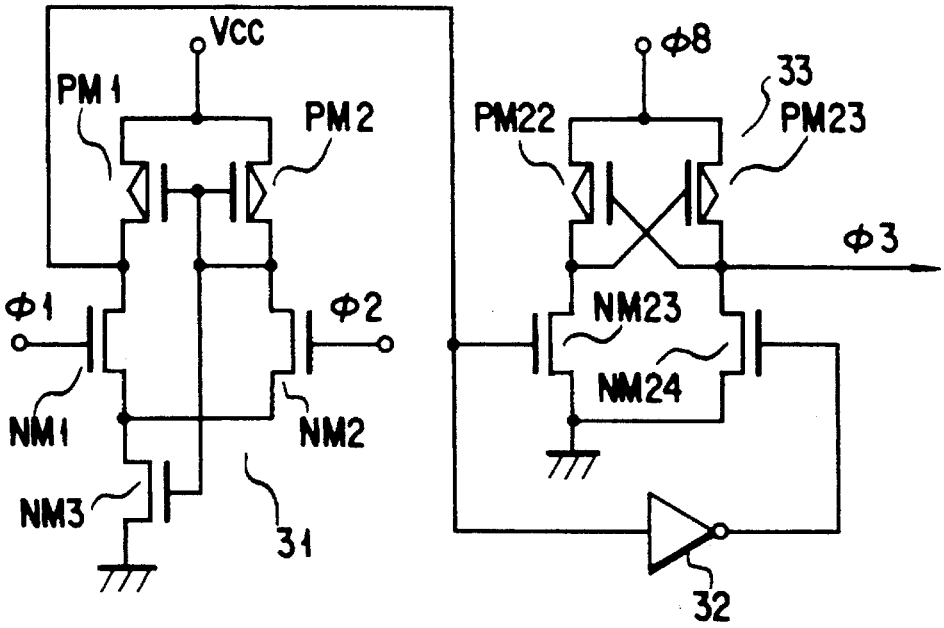
FIG. 7

SEMICONDUCTOR INTEGRATED CIRCUIT FOR GENERATING CONSTANT INTERNAL VOLTAGE

BACKGROUND OF THE INVENTION

1. Field of the Invention

The present invention relates to a semiconductor integrated circuit (hereinafter referred to as an IC) having an internal voltage generating circuit capable of providing an internal voltage having little dependency on a variation of an external power supply voltage.

2. Description of the Related Art

In a currently used dynamic random access memory (DRAM), it is desired that a voltage be generated by an IC itself, rather than using an external power supply voltage. Thereby, even if a plurality of voltage levels are required in the IC, only a single external power supply voltage may be supplied to the IC. In a modern DRAM, a single external power supply voltage is employed, and other necessary voltages are generated within the IC. The external power supply voltage is determined according to the breakdown voltage of the IC, the use of the IC, etc. It is inevitably required to reduce the external power supply voltage, coping with of an increase in integration density, a decrease in power consumption, and an electric cell-powered operation.

On the other hand, a voltage required within the IC is selected in consideration of the thickness of an oxide film of an MOS transistor used in the IC, power consumption, data write potential in memory cells, and reliability and so on. According to the natural scaling rule, it is supposed that the power supply voltage is scaled similarly. Although a decrease in voltage is required both for the external power supply voltage and internal power supply voltage, the required voltage is not necessarily equal. In order to ensure that the IC operates in a wide range of external power supply voltages, it is desired that an internal voltage with low dependency on the external power supply voltage be generated. Conventional internal voltage generating circuits include one using a charge pump and one using a bootstrap in a case where a potential higher than an external power supply voltage is generated, and also one using a charge pump and one using a voltage-decrease circuit in the case of a potential lower than an external power supply voltage is generated.

In the prior art, an internal voltage-decrease circuit generates a voltage with low dependency on the external power supply voltage, thereby ensuring highly reliable operation in a wider range of operation power supply voltages. In this system, however, the range of internal voltages that can be set is considerably limited due to the above-mentioned lowering of the external power supply voltage. In particular, when the external power supply voltage is low, the operation margin of the IC is decreased.

On the other hand, in a system wherein voltage is boosted by a boost circuit over the entire range of normal operation power supply voltages of the IC, when the external power supply voltage is high, the IC may be damaged or the reliability of the IC is degraded due to a decrease in thickness of oxide films of MOS transistors used in the IC. Furthermore, in the prior art in which the relationship between a high level and a low level of the external power supply voltage is reversed, the same problem as above occurs. The above problem applies not only to DRAMs but also to other types of high integration density semiconductor ICs.

In order to ensure the operation of the IC over the wide range of external power supply voltages, as mentioned above, it is desirable to generate an internal voltage with low dependency on the external power supply voltage.

Suppose an internal voltage with low dependency on the external power supply voltage is generated by using a voltage-decrease circuit which generates an internal voltage lower than a high-voltage-side power supply voltage Vcc of the external power supply voltage. In this case, if the high-voltage-side power supply voltage is varied towards a narrower range of variation, the input voltage becomes the internal voltage as it is, and it is not sufficiently boosted. As a result, the operation margin of the IC may occur.

Suppose an internal voltage with low dependency on an external power supply voltage is generated by using a voltage boost circuit which generates an internal voltage higher than a high-voltage-side power supply voltage Vcc of the external power supply voltage. In this case, if the high-voltage-side power supply voltage is varied towards a wider range of variation, the input voltage becomes the internal voltage as it is, and it is not sufficiently decreased. As a result, an excess voltage is generated, and the IC may be damaged or the reliability of the IC may be degraded.

The above problem will occur when the voltage Vcc is boosted or decreased, for example, in the case where the internal voltage is applied to a gate of an N-channel transfer transistor.

Inversely, when the internal voltage is applied to a gate of a P-channel transfer transistor, the relationship between the high-voltage-side power supply voltage Vcc and low-voltage-side power supply voltage Vss (ground potential) of the external power supply voltage is reversed. Specifically, suppose an internal voltage with low dependency on an external power supply voltage is generated by using a voltage boost circuit which generates an internal voltage higher than a low-voltage-side power supply voltage Vss. In this case, if the high-voltage-side power supply voltage is varied towards a narrower range of variation, the potential difference between the internal voltage and high-voltage-side power supply voltage becomes insufficient, and the operation margin of the IC is decreased.

On the other hand, suppose that an internal voltage with low dependency on an external power supply voltage is generated by using a voltage-decrease circuit which generates an internal voltage lower than a low-voltage-side power supply voltage Vss of the external power supply voltage. In this case, if the high-voltage-side power supply voltage is varied towards a wider range of variation, the potential difference between the internal voltage and external power supply voltage becomes too great, and the IC may be damaged or the reliability of the IC may be degraded.

In any case, considerable limitations are put on the set level of the internal voltage, and the range of operation power supply voltages is limited and the reliability is degraded.

SUMMARY OF THE INVENTION

It is an object of the present invention to provide a semiconductor integrated circuit which is able to operate in a wide range of an outer power source voltage and which has a high reliability in its operation.

According to the present invention, there is provided a semiconductor integrated circuit a function of providing an internal voltage having little dependency on a variation of external power supply voltage, said circuit comprising:

reference voltage generating means for generating a reference voltage and for outputting said reference voltage as a first output;

voltage converting means for converting an outer power source voltage to a lower voltage than said outer power source voltage and for outputting said lower voltage as a second output, a level of said second out-put being changed in accordance with a level of said outer power source voltage;

voltage-decrease/boosting selecting means for receiving said first and second outputs and for comparing a level of said first output with that of said second output thereby outputting a third output, a level of said third output being changed when a level of said outer power source voltage exceeds a prescribed value;

voltage-decrease means for receiving said third output to constantly decrease said outer power source voltage and for outputting an internal voltage when said third output has a first level;

boosting means for receiving said third output to constantly boost said outer power source voltage and for outputting said internal voltage when said third output has a second level;

internal voltage limiting means for receiving said first output and a fourth output outputted from said voltage-decrease means, a level of said fourth output being changed in accordance with a level of said internal voltage, and for outputting a fifth output to control a decreasing amount of said voltage-decrease means and a boosting amount of said boosting means; and an internal circuit for receiving said internal voltage.

Still further according to the present invention there is provided a semiconductor integrated circuit having a function of providing an internal voltage having little dependency on a variation of external power supply voltage, said circuit comprising:

reference voltage generating means for generating a reference voltage and for outputting said reference voltage as a first output;

voltage-decrease limiting means for receiving said first output and a second output outputted from voltage-decrease means and for outputting a third output to said voltage-decrease means;

said voltage-decrease means for receiving said third output to maintain a level of a fourth output constant outputted thereform;

boosting means for receiving said fourth output outputted from said voltage-decrease means and for boosting said fourth output to output an internal voltage;

internal voltage limiting means for receiving said first output and said internal voltage and for outputting a fifth output to said boosting means to make a level of boosting of said boosting means constant; and and internal circuit for receiving said internal voltage.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIG. 6A to FIG. 6D are other detailed configurations of the reference voltage generating circuit other than that shown in FIG. 3;

FIG. 7 is another detailed configuration of the voltage decreasing/boosting selection circuit other than that shown in FIG. 3;

DETAILED DESCRIPTION OF THE PREFERRED EMBODIMENTS

Embodiments of the present invention will now be described with reference to the accompanying drawings.

Figure 1:
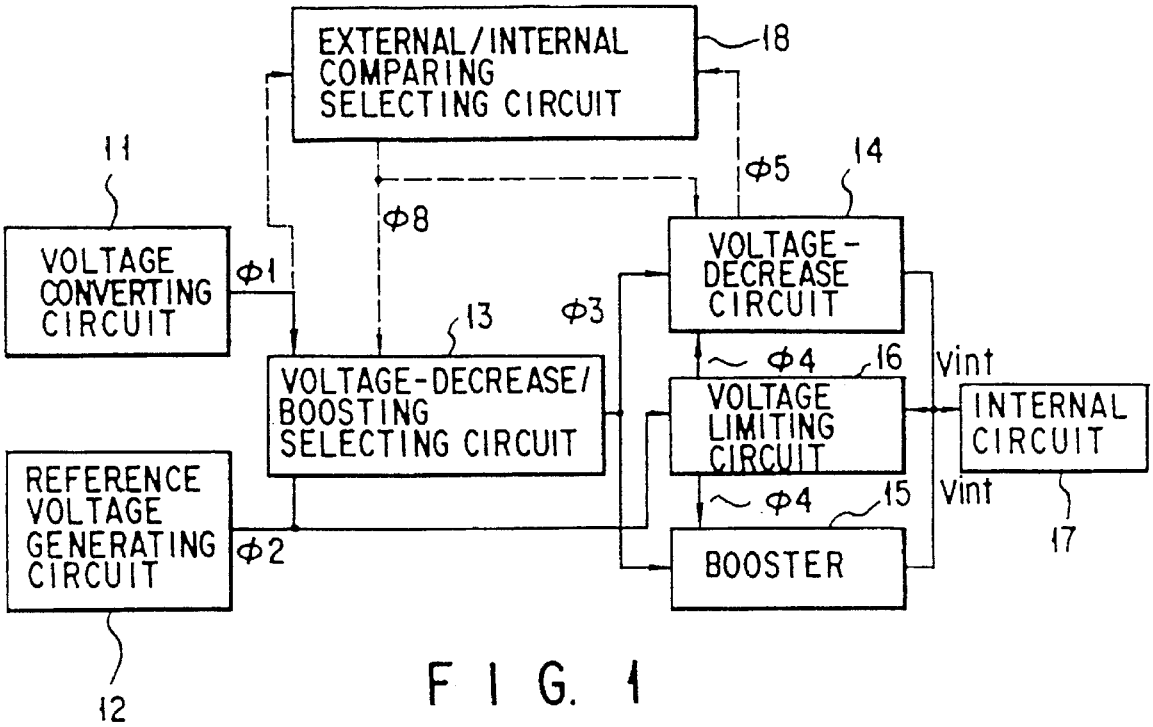
FIG. 1 is a block circuit diagram showing a semiconductor integrated circuit of a first embodiment of the present invention.

FIG. 1 is a block circuit diagram showing a semi-conductor integrated circuit (IC) having an internal voltage generating circuit, according to a first embodiment of the present invention.

In FIG. 1, reference numeral 11 denotes a voltage converting circuit, and numeral 12 a reference voltage generating circuit. A voltage-decrease/boosting selecting circuit 13 is supplied with an output $\phi 1$ from the voltage converting circuit 11 and an output $\phi 2$ from the reference voltage generating circuit 12. A voltage-decrease circuit 14 is controlled in accordance with an output $\phi 3$ of the voltage-decrease/boosting selecting circuit 13, and the circuit 14 is operated to constantly decrease an external power supply voltage Vcc and output an internal voltage Vint. A booster 15 is controlled in accordance with the output $\phi 3$ of the voltage-decrease/boosting selecting circuit 13, and the circuit 15 is operated to constantly boost the external power supply voltage Vcc and output an internal voltage Vint. An internal voltage limiting circuit 16 is supplied with the output $\phi 2$ of the reference voltage generating circuit 12 and the internal voltage Vint, and the limiting circuit 16 controls the decrease amount and boost amount of the external power supply voltage Vcc of the voltage-decrease circuit 14 and booster 15 on the basis of its output $\phi 4$, so as to make substantially constant the value of the internal voltage Vint. An internal circuit 17 is supplied with the internal voltage Vint. An external/internal voltage comparing/selecting circuit 18 compares the external power supply voltage Vcc and internal voltage Vint on the basis of the output $\phi 1$ of the voltage converting circuit 11 and output $\phi 5$ of the voltage-decrease circuit 14, and supplies the higher voltage, as output $\phi 8$, to the voltage-decrease/boosting selecting circuit 13 and voltage-decrease circuit 14.

The voltage converting circuit 11 has a function of decreasing the external power supply voltage Vcc. For example, the circuit 11 divides the voltage Vcc by use of a resistor, and output the divided voltage as output $\phi 1$. The reference voltage generating circuit 12 generates a voltage having low voltage-dependency on the external power supply voltage Vcc and low-temperature dependency. For example, by using a band-gap reference circuit comprising bipolar transistors or a MOS transistor in which no channel ions are injected, a substantially constant voltage is generated and the generated voltage is output as output $\phi 2$. The voltage-decrease/boosting selecting circuit 13 as combined with the out-put $\phi 1$ of voltage converting circuit 11 and the output $\phi 2$ of reference voltage generating circuit 12 determines a switching voltage Vsw in the voltage-decrease/boosting selecting circuit 13 for switching the operation of the voltage-decrease circuit 14 and booster 15. Although the switching voltage Vsw can be freely chosen, the advantage of the invention is enhanced by setting it at the normal operation voltage of the IC. The reason for this is that the degree of freedom for setting the internal voltage is increased by setting the switching voltage at the normal operation voltage of the IC.

In particular, the switching voltage Vsw is set at a value at which the levels of outputs $\phi 1$ and $\phi 2$ become equal, and either the voltage-decrease circuit 14 or booster 15 performs its function on the basis of output $\phi 3$ of the voltage-decrease/boosting selecting circuit 13 in the vicinity of the switching voltage Vsw.

The voltage-decrease/boosting selecting circuit 13, though described later in detail, has a comparing circuit for comparing the outputs $\phi 1$ and $\phi 2$, and it outputs a voltage close to a ground potential as output $\phi 3$ when the output $\phi 1$ is higher than the output $\phi 2$. At this time, the voltage-decrease circuit 14 is operated. Inversely, when the output $\phi 1$ is lower than the output $\phi 2$, the selecting circuit 13 outputs a voltage close to the external power supply voltage supplied to the comparing circuit as output $\phi 3$. At this time, the booster 15 is operated.

The internal voltage limiting circuit 16 functions to keep the internal voltage Vint at a predetermined level and it has a voltage conversion circuit for dividing the internal voltage Vint and a comparing circuit. The comparing circuit compares the output level of the voltage conversion circuit and the output $\phi 2$ of the reference voltage generating circuit 12. The operations of the voltage-decrease circuit 14 and booster 15 are controlled by the output $\phi 4$ of this comparing circuit. Accordingly, the voltage-decrease circuit 14 cooperates with the internal voltage limiting circuit 16, thus functioning as a feed-back type voltage-decrease circuit. Specifically, a reference signal and a signal based on the internal voltage are compared by the comparing circuit of the internal voltage limiting circuit 16, and the comparison signal is delivered to the gate of a MOS transistor in the output stage. The MOS transistor controls the current fed from the external power supply voltage Vcc, thereby decreasing the external power supply voltage Vcc. There are two methods for decreasing voltage. According to one method, a charge-pump circuit is used, and according to the other method, the current from the external power supply is limited. The present invention adopts the latter method.

The booster 15 is known as a charge-pump type booster, though it will be described later in detail. The boosting operation of the booster 15 is controlled by the output $\phi 3$ of the voltage-decrease/boosting selecting circuit 13 and the output $\phi 4$ of the internal voltage limiting circuit 16. The booster 15 comprises a clock generating circuit, a buffer circuit for amplifying the clock generated by the clock generating circuit, and a charge-pump circuit. There are well-known voltage-boosting methods wherein a bootstrap circuit or a charge-pump circuit is employed. Since the boosted potential is used as power supply potential in the present invention, the charge-pump circuit capable of obtaining a boosted potential is suitable for the present invention.

The output from the voltage-decrease circuit 14 and booster 15, i.e. the internal voltage Vint, is supplied as a power supply voltage to the internal circuit 17. The internal circuit 17 is formed on the same semiconductor substrate as the voltage converting circuit 11, reference voltage generating circuit 12, voltage-decrease/boosting selecting circuit 13, voltage-decrease circuit 14, booster 15, internal voltage limiting circuit 16, and external/internal voltage comparing/selecting circuit 18. The internal circuit 17 is constituted by, e.g. a DRAM circuit comprising a great number of dynamic memory cells. The internal voltage Vint is finally supplied to word lines of the DRAM circuit.

The external/internal voltage comparing/selecting circuit 18 compares the external power supply voltage Vcc and internal voltage Vint and outputs the higher one as voltage $\phi 8$. Although described later in detail, the circuit 18 comprises a comparing circuit for comparing the output $\phi 1$ of the voltage converting circuit 11 and the output $\phi 5$ of the voltage-decrease circuit 14, an inverting circuit receiving the output of this comparing circuit, and a voltage switching circuit for outputting the voltages Vcc and Vint in a switching manner on the basis of the outputs of the inverting circuit and comparing circuit.

Figure 2:
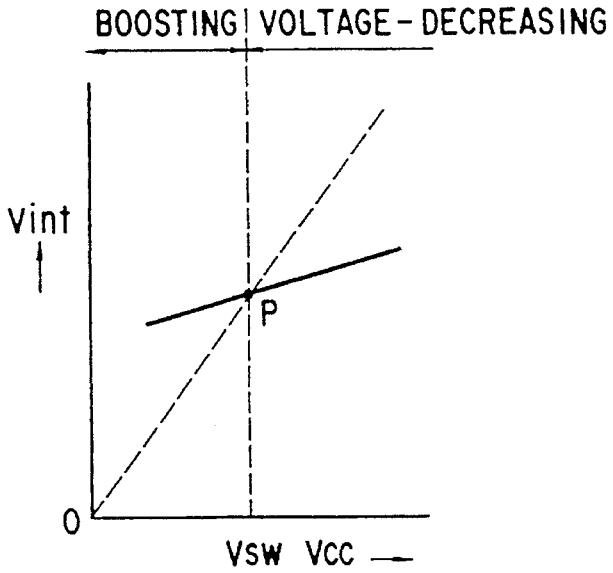
FIG. 2 is a graph showing a relation between an outer power source voltage and an internal voltage using a switching voltage.

In the circuit having the above structure, when the value of switching voltage Vsw set by the voltage converting circuit 11, reference voltage generating circuit 12 and voltage-decrease/boosting selecting circuit 11 is higher than the external power supply voltage Vcc, the voltage of output $\phi 2$ of the voltage converting circuit 11 is lower than that of output $\phi 2$ of the reference voltage generating circuit 12. At this time, the output $\phi 3$ of the voltage-decrease/boosting circuit 13 becomes close to the power supply voltage supplied to the comparing circuit within the voltage-decrease/boosting circuit 13. Upon application of the output $\phi$3, the booster 15 is operated. Thus, as shown in FIG. 2, in a region where the switching voltage Vsw is higher than the external power supply voltage Vcc, the internal voltage Vint higher than the external power supply voltage Vcc is obtained by the booster 15, and this voltage is supplied to the internal circuit 17.

On the other hand, when the switching voltage Vsw is lower than the external power supply voltage Vcc, the voltage of output $\phi$1 of the voltage converting circuit 11 becomes higher than the voltage of output $\phi$2 of the reference voltage generating circuit 12. At this time, the output $\phi$3, of the voltage-decrease/boosting circuit 13 becomes close to the ground potential. Upon application of the output $\phi$3, the voltage-decrease circuit 14 is operated. Thus, as shown in FIG. 2, in a region where the switching voltage Vsw is lower than the external power supply voltage Vcc, the internal voltage Vint lower than the external power supply voltage Vcc is obtained by the voltage-decrease circuit 14, and this voltage is supplied to the internal circuit 17.

The detailed structure of the circuit of the above embodiment will now be described.

Figure 3:
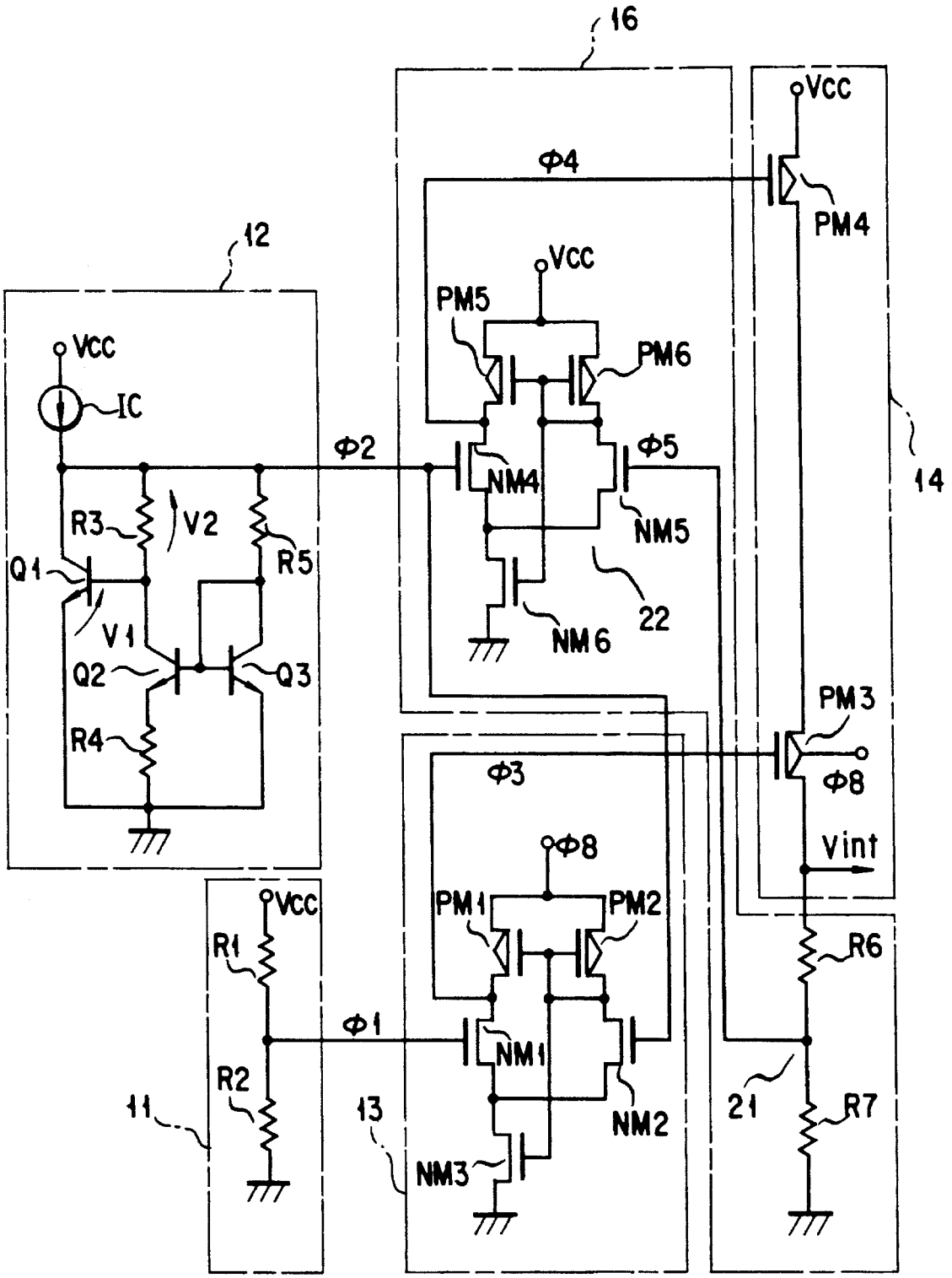
FIG. 3 is detailed configurations of a voltage converting circuit, a reference voltage generating circuit, a voltage decreasing/boosting selection circuit, a voltage-decreasing circuit and an internal voltage limiting circuit shown in FIG. 1.

FIG. 3 shows detailed circuit structures of the voltage converting circuit 11, reference voltage generating circuit 12, voltage-decrease/boosting selecting circuit 13, voltage-decrease circuit 14, and internal voltage limiting circuit 16.

As described above, the voltage converting circuit 11 has a function of converting the external power supply voltage Vcc to a lower voltage, thereby to set to a desired value the switching voltage determined by the output $\phi$1 of the voltage converting circuit 11, the out-put $\phi$2 of the reference voltage generating circuit 12 and the voltage-decrease/boosting selecting circuit 13. The voltage converting circuit 11 comprises, as shown in FIG. 3, two resistors R1 and R2 connected in series between an external power supply voltage Vcc and a ground potential, and the voltage at a node between the resistors R1 and R2 is derived as output $\phi$1.

The reference voltage generating circuit 12 functions to generate a voltage with low output-voltage-dependency on the external power supply voltage Vcc and low temperature-dependency, as described above. In this embodiment, a band-gap reference circuit is used. This circuit comprises a constant current source IC having one end connected to a voltage Vcc; a bipolar transistor Q1 having a collector connected to the other end of the constant current source IC and an emitter connected to a ground potential; a resistor R3 connected between the other end of the constant current supply IC and the base of the transistor Q1; a bipolar transistor Q2 having a collector connected to the base of the transistor Q1 and an emitter connected to the ground potential via a resistor R4; a bipolar transistor Q3 having a collector and a base connected to the base of the transistor Q2 and an emitter connected to the ground potential; and a resistor R5 inserted between a common node of the collector and base of the transistor Q3 and the other end of the constant current source IC.

This circuit makes use of the fact that the temperature coefficient of a voltage V1 occurring between the base and emitter of the transistor Q1 having a negative temperature coefficient varies in accordance with the emitter current density thereof. A voltage V2 having a positive temperature coefficient, which occurs between both ends of the resistor R3, is added to the voltage V1. Thereby, a stable voltage free from temperature dependency can be obtained as $\phi$2.

The voltage-decrease/boosting selecting circuit 13 is constituted by a comparing circuit having a CMOS construction which comprises P-channel MOS transistors PM1 and PM2 and N-channel MOS transistors NM1, NM2 and NM3 and receives the output $\phi$1 of the voltage converting circuit 11 and the output $\phi$2 of the reference voltage generating circuit 12. This comparing circuit is supplied with an output $\phi$8, and not with the external power supply voltage Vcc, as power supply voltage, as will be described later.

The voltage-decrease circuit 14 comprises a P-channel MOS transistor PM3 or controlling the switching operation of the voltage-decrease circuit 14, which transistor PM3 has a source-drain passage between a node for obtaining the internal voltage Vint and the terminal Vcc, and a P-channel MOS transistor PM4 for controlling the voltage-decrease function of the voltage-decrease circuit 14, which transistor PM4 has a source-drain passage inserted in series with the source-drain passage of the MOS transistor PM3. The gate of the MOS transistor PM3 is supplied with the output from the voltage-decrease/boosting selecting circuit 13 and the back-gate of the MOS transistor PM3 is supplied with an output $\phi$8 (described later). The gate of the MOS transistor PM4 is supplied with the output $\phi$4 from the internal voltage limiting circuit 16. In this voltage-decrease circuit 14, when the output $\phi$4 is at low voltage, the MOS transistor PM4 is turned on and the voltage-decrease operation is enabled. At this time, the value of current from the external power supply voltage Vcc is controlled in accordance with the voltage of the output $\phi$3, and hereby the voltage-decrease control is effected. A description will be given later on the supply of output $\phi$8 to the back-gate of the MOS transistor PM3 for performing the voltage-decrease operation.

The internal voltage limiting circuit 16 comprises the voltage converting circuit 21 for dividing the internal voltage Vint and comparing circuit 22, as has been described above. The voltage converting circuit 11 comprises two resistors R6 and R7 inserted between the node for obtaining the internal voltage Vint and the ground potential. An output $\phi$5 is obtained at a node between the two resistors. The comparing circuit 22 has a CMOS construction which comprises P-channel MOS transistors PM5 and PM6 and N-channel MOS transistors NM4, NM5 and NM6 and receives the output $\phi$2 of the reference voltage generating circuit 12 and the output $\phi$5 from the voltage converting circuit 21. The output $\phi$4 from the internal voltage limiting circuit 16 is supplied to the gate of the P-channel MOS transistor PM4 within the voltage-decrease circuit 14. The ratio of the two resistors R6 and R7 within the voltage converting circuit 21 is substantially equal to the ratio of the two resistors R1 and R2 within the voltage converting circuit 11. Accordingly, when the internal voltage Vint does not reach a desired value, the output $\phi$5 is lower than the output $\phi$2, and a voltage close to the ground potential is output as output $\phi$4. Inversely, when the internal voltage Vint exceeds the desired value, the output $\phi$5 is higher than the output $\phi$2, and a voltage close to the external power supply voltage Vcc of the comparing circuit is output as $\phi$4.

Specifically, the output $\phi$4 has a level corresponding to the internal voltage Vint. In other words, when the level of the internal voltage Vint increases, the level of output $\phi$4 is varied so as to decrease the internal voltage Vint. For example, if the internal voltage Vint varies while the external power supply voltage Vcc is decreased by the voltage-decrease circuit 14, the output $\phi$4 decreases to a low level so as to cancel the variation of the internal voltage Vint. Thus, the P-channel MOS transistor PM4 is turned on, and a current is supplied from the terminal Vcc to the terminal Vint so that the level of Vint may increase. Accordingly, the comparing circuit 11 forms a negative feedback loop. The same operation is performed while the booster 15 performs the boosting operation.

Figure 4:
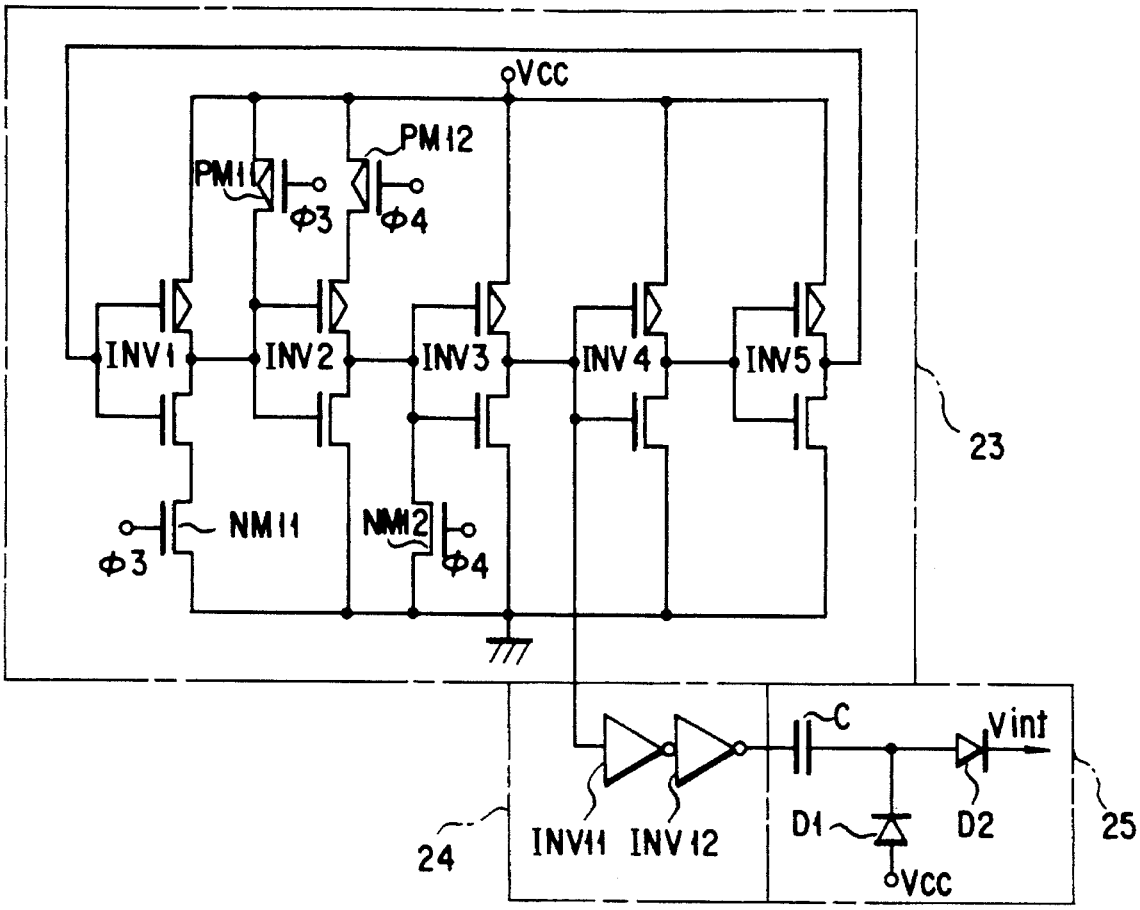
FIG. 4 is a detailed configuration of a booster shown in FIG. 1.

FIG. 4 shows a detailed structure of the booster 15 according to the above embodiment. This booster is known as a charge-pump type booster. FIG. 4 shows an example of a comprising a clock generator 23, a buffer circuit 24 and a charge-pump circuit 25.

The clock generator 23 comprises an odd number (e.g. 5) of CMOS inverters INV1 to INV5 each having a P-channel MOS transistor and an N-channel MOS transistor. The output of each inverter drives the next-stage inverter, and the output of the final-stage inverter is fed back to the first-stage inverter in a feedback loop. The inverters constitute a ring oscillator. For example, the source-drain passage of the P-channel MOS transistor PM11, whose gate receives the output ϕ3 from the voltage-decrease/boosting selecting circuit 13, is inserted between the input node of the inverter INV2 and the external power supply voltage Vcc. The source-drain passage of the P-channel MOS transistor PM12, whose gate receives the output ϕ4 from the internal voltage limiting circuit 16, is inserted between the source of the P-channel side MOS transistor of the inverter INV2 and the external power supply voltage Vcc. The source-drain passage of the N-channel MOS transistor NM11, whose gate receives the output ϕ3, is inserted between the source of the P-channel side MOS transistor of the inverter INV1 and the ground potential. In addition, the source-drain passage of the N-channel MOS transistor NM12, whose gate receives the output ϕ4, is inserted between the input node of the inverter INV3 and the ground potential.

The MOS transistors PM11, PM12, NM11 and NM12 are provided to control the operation of the clock generating circuit 23. The MOS transistors PM12 and NM11 function as a switch for stopping oscillation. The MOS transistors PM11 and NM12 function as a switch for applying a potential to each inverter when oscillation is stopped. The MOS transistors PM11 and NM12 are not indispensable and may be omitted. In this embodiment, the outputs ϕ3 and ϕ4 are used as control signals without performing logical arithmetic operations. However, the outputs ϕ3 and ϕ4 may be subjected to logical arithmetic operations, and a single operation control MOS transistor may be provided for each of the P-channel side and N-channel side. In this case, signals obtained by logical arithmetic operations are fed to the gates of the operation control MOS transistors.

The buffer circuit 24 receives the clock generated by the clock generating circuit 23 and drives the charge-pump circuit 25. In this embodiment, a plurality (e.g. 2) of inverters INV11 and INV12 are connected in series in multiple stages. The buffer circuit 24 supplies a current which is sufficient to drive a capacitor provided in the charge-pump circuit 25 (described later in detail). In the case where a complex charge-pump circuit is employed, the buffer circuit is provided with a function of wave-shaping necessary various timing pulses.

The charge-pump circuit 25 pumps a positive charge from the external power supply voltage Vcc by using the output of the buffer circuit 24, thereby boosting the voltage. Specifically, the charge-pump circuit 25 comprises a capacitor C having one end supplied with the output of the buffer circuit 24, a diode D1 having an anode connected to the external power supply voltage Vcc and a cathode connected to the other end of the capacitor C, and a diode D2 having an anode connected to the other end of the capacitor C and a cathode connected to a node for obtaining the internal voltage Vint. The diode D1 allows passage of the positive charge from the terminal Vcc to the capacitor C when the output of the buffer circuit 24 decreases from Vcc to the ground potential, and prevents passage of the charge when the output of the buffer circuit 24 rises from the ground potential to Vcc. Similarly, the diode D1 prevents passage of the charge when the output of the buffer circuit 24 decreases from Vcc to the ground potential, and allows passage of the positive charge from the capacitor C to the internal voltage Vint when the output of the buffer circuit 24 rises from the ground potential to Vcc. Accordingly, the positive charge flows from terminal Vcc to terminal Vint, and thereby the potential of terminal Vint can be increased to the external power supply voltage Vcc or above. The charge-pump circuit 25 shown in the figure is an example of this principle, it is also possible to use another charge-pump circuit constructed by using a MOS transistor on the basis of the charge-pump method.

In the circuit of the present embodiment, both the internal voltage level at the time of voltage-decreasing and the internal voltage level at the time of boosting can be controlled by the output ϕ4 of the internal voltage limiting circuit 16. In other words, the comparing circuit 22 within the internal voltage limiting circuit 16 constituting the feedback type voltage-decrease circuit has a function of controlling the internal voltage level even at the time of boosting. Accordingly, there is no need to provide voltage limiting circuits independently for the voltage-decrease circuit 14 and booster 15, and the internal voltage level can be controlled at the time of voltage-decreasing and boosting with the simple circuit configuration.

As regards the circuit of this embodiment, the following must be taken into account: when the booster 15 is operated and the internal voltage Vint becomes higher than the external power supply voltage Vcc, it is necessary that the back-gate potential of the P-channel MOS transistor PM3 within the voltage-decrease circuit 14 connected directly to the terminal Vint be set at the internal voltage Vint and the gate potential thereof be set at a value between the internal voltage Vint and the ground potential; inversely, when the voltage-decrease circuit 15 is operated and the internal voltage Vint becomes lower than the external power supply voltage Vcc, it is necessary that the back-gate potential of the MOS transistor PM3 be set at the external power supply voltage Vcc and the gate potential thereof be set at a value between the external power supply voltage Vcc and the ground potential. By applying such back-gate potential to the MOS transistor PM3, a forward bias state can be prevented from occurring between the source/drain diffusion layer and the back-gate. In addition, by applying the above potential to the gate of the MOS transistor PM3, a malfunction due to the turn-on state of the MOS transistor can be prevented when the following relationship is established with respect to the output ϕ3, internal voltage Vint, and threshold voltage Vth of MOS transistor PM3: $(\phi 3 + |VH|) < Vint$. Thus, it is necessary to provide the external/internal voltage comparing/selecting circuit 18 for comparing the internal voltage Vint with the external power supply voltage Vcc and selecting the higher voltage.

Figure 5:
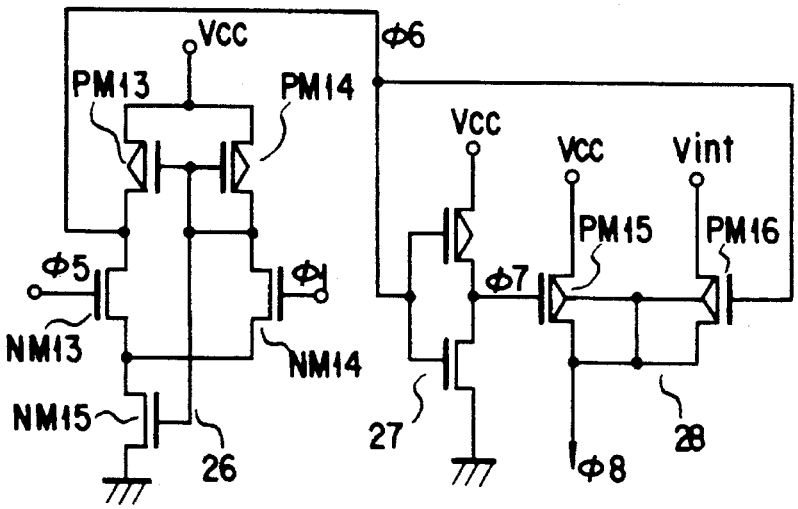
FIG. 5 is a detailed configuration of an outer/internal voltage comparing selection circuit shown in FIG. 1.

FIG. 5 shows a detailed structure of the external/internal voltage comparing/selecting circuit 18. This circuit comprises a comparing circuit 26 constituted by P-channel MOS transistors PM13 and PM14 and N-channel MOS transistors NM13, NM14 and NM15. The comparing circuit 26 compares the output ϕ5 of the voltage converting circuit 21 within the internal voltage limiting circuit 16 with the output ϕ1 of the voltage converting circuit 11. When ϕ1 is lower than ϕ5, the output ϕ6 of the comparing circuit is close to the external power supply voltage Vcc. On the other hand, when $\phi 1$ is higher than $\phi 5$, the output $\phi 6$ of the comparing circuit is close to the ground potential. The output $\phi 6$ of the comparing circuit 26 is supplied to a CMOS inverter comprising a P-channel MOS transistor and an N-channel MOS transistor. The output $\phi 6$ of the comparing circuit 26 as well as an output $\phi 7$ of the inverter 27 is supplied to a voltage switching circuit 28.

The voltage switching circuit 18 comprises a P-channel MOS transistor PM15 having a source connected to the terminal Vcc and a gate supplied with the output $\phi 7$ of the inverter 27, and a P-channel MOS transistor PM16 having a source connected to the terminal Vint and a gate supplied with the output $\phi 6$ of the comparing circuit 26. The back-gates and drains of the two MOS transistors PM15 and PM16 of the voltage switching circuit 28 are commonly connected, and an output $\phi 8$ is derived from the common node thereof.

In the external/internal voltage comparing/selecting circuit 18 having the above structure, when the external power supply voltage Vcc is higher than the internal voltage Vint, the output $\phi 6$ is close to the external power supply voltage Vcc and the P-channel MOS transistor PM16 within the voltage switching circuit 28 is turned off. Since the output $\phi 7$ has substantially the ground potential, the P-channel MOS transistor PM15 of the voltage switching circuit 18 is turned on and the output $\phi 8$ becomes equal to the external power supply voltage Vcc. Inversely, when the external power supply voltage Vcc is lower than the internal voltage Vint, the output $\phi 6$ is close to the ground potential, the P-channel MOS transistor PM16 is turned on, the P-channel MOS transistor PM15 is turned off, and the output $\phi 8$ is equal to the internal voltage Vint. Accordingly, this circuit compares the internal voltage Vint and external power supply voltage Vcc, thereby outputting the higher voltage as an output $\phi 8$. In order to solve the above problem with the P-channel MOS transistor PM3 of voltage-decrease circuit 14 by making use of the output $\phi 8$, it would suffice to supply the output $\phi 8$ to the back-gate of the MOS transistor PM3 and set the gate signal $\phi 3$ of MOS transistor PM3 at the potential between the output $\phi 8$ and the ground potential, and not at the potential between the external power supply voltage Vcc and the ground voltage. Further, in order to set the output $\phi 3$ at the potential between the output $\phi 8$ and the ground potential, it would suffice to supply the output $\phi 8$, as power supply voltage, to the comparing circuit within the voltage-decrease/boosting selecting circuit 13 for producing the output $\phi 3$, as shown in FIG. 3.

In the voltage-decrease circuit 14 shown in FIG. 3, it is possible to interchange the MOS transistors PM3 and PM4, i.e. to supply the output $\phi 3$ to the gate of the MOS transistor PM4 and the output $\phi 4$ to the gate of the MOS transistor PM3. In this case, it is necessary to provide the above-mentioned countermeasures for the back-gate potential and gate potential of both MOS transistors PM3 and PM4.

FIGS. 6A to 6D show various modifications of the circuit structure of the reference voltage generating circuit 12 shown in FIG. 3. A reference voltage generating circuit shown in FIG. 6A comprises an n-number of series-connected diodes D11-1 to D11-n and a resistor R11 from which a current is supplied to these diodes. The voltage of output $\phi 2$ is determined by n-times the forward voltage VF of the diode and the equivalent turn-on resistance of the diodes. In a reference voltage generating circuit shown in FIG. 6B, the diodes in FIG. 6A are replaced by P-channel MOS transistors PM21-1 to PM21-n, and in this case the voltage of the output $\phi 2$ is determined by n-times the absolute value |Vthl of the threshold voltage of the P-channel MOS transistor and the equivalent turn-on resistance of the MOS transistor. In a reference voltage generating circuit shown in FIG. 6C, the resistor R11 in FIG. 6B is replaced by a P-channel MOS transistor PM22. In a reference voltage generating circuit shown in FIG. 6D, the P-channel MOS transistors in FIG. 6C are replaced by N-channel MOS transistors NM21-1 to NM21-n and NM22.

As has been described above, the gate voltage range of the P-channel MOS transistor PM3 within the voltage-decrease circuit 14 needs to be varied in accordance with the boosting operation and the voltage-decrease operation. This is achieved by supplying the output $\phi 8$ of the external/internal voltage comparing/selecting circuit 18 (FIG. 5), as power supply voltage, to the comparing circuit. However, it is possible to use the external power supply voltage Vcc as the power supply voltage for the comparing circuit and obtain the voltage between the output $\phi 8$ and the ground potential from the voltage between the external power supply voltage Vcc and the ground potential for the comparing circuit.

FIG. 7 shows another circuit configuration structure of the voltage-decrease/boosting selecting circuit 13 of the above type. The selecting circuit 13 comprises a comparing circuit 31 , an inverter 32 and a comparing circuit 33. The comparing circuit 31 comprises P-channel MOS transistors PM1 and PM2 and N-channel MOS transistors NM1, NM2 and NM3 and is supplied with the external power supply voltage Vcc as power supply voltage. The inverter 32 inverts the output from the comparing circuit 31. The comparing circuit 33 comprises P-channel MOS transistors PM23 and PM24 and N-channel MOS transistors NM23 and NM24 and is supplied with the output $\phi 8$ as power supply voltage and also supplied with the outputs from the comparing circuit 31 and inverter 32.

There is prior art wherein either the booster or voltage-decrease circuit is operated over the entire range of power supply voltages in the normal operation mode. In this prior art, the degree of freedom for setting the internal voltage is low, and it is difficult to obtain the internal voltage which meets the requirements in characteristics within the IC. By contrast, according to the circuit of the present embodiment, both the booster and voltage-decrease circuit are provided, and one of them is operated in accordance with the value of the external power supply voltage, thereby obtaining the internal voltage. Thus, the degree of freedom for setting the internal voltage increases and the optimal internal voltage for the characteristics of the IC can be obtained.

In the above embodiment, the internal circuit 17 is the DRAM circuit. The internal voltage generating circuit according to the embodiment can be used as internal power sources for various integrated circuits. In the case where the internal circuit 17 is the DRAM circuit, the internal voltage source becomes effective as a driving power source for word lines. The reason for this is that the potential of word lines determines the potential for write in memory cells. Even in the case where the external power supply voltage is low, the writing of a sufficient amount of information in memory cells requires that a sufficient potential must be applied to word lines at least within a range of low external power supply voltages. In particular, in the case where N-channel cell transfer transistors are used, it is desirable that a potential boosted above the external power supply voltage be supplied to word lines in a region of low external power supply voltages Vcc.

In the above embodiment, both the voltage-decrease circuit and booster are employed. However, there may be an embodiment where the voltage-decrease circuit is not included.

Figure 8:
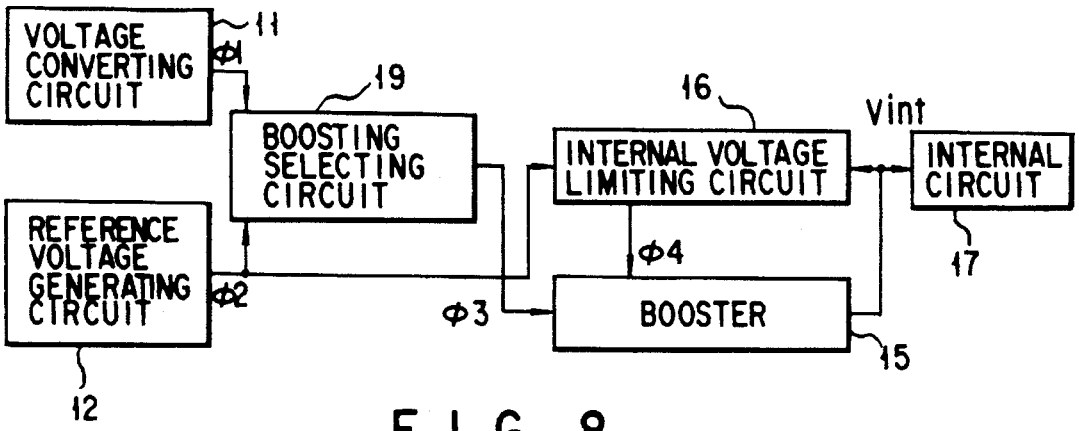
FIG. 8 is a block diagram showing a semiconductor integrated circuit of a second embodiment of the present invention.
Figure 9:
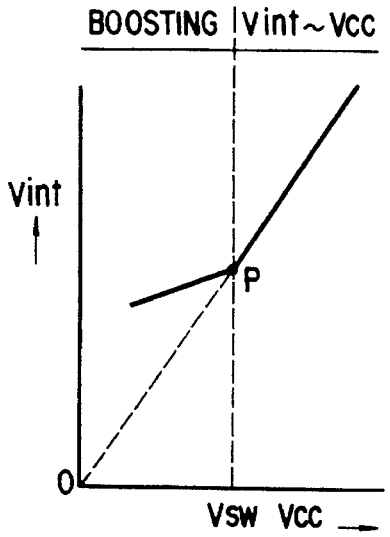
FIG. 9 is a graph showing a relation between an outer power source voltage and an internal voltage using a switching voltage.

FIG. 8 is a block diagram according to a second embodiment of the invention, wherein only the voltage-decrease circuit is included. The circuit of this embodiment differs from the first embodiment of FIG. 1 in that the voltage-decrease circuit 14 and external/internal voltage comparing/selecting circuit 18 are not necessary, and the voltage-decrease/boosting selecting circuit 13 is replaced by a boosting selecting circuit 19 having a similar circuit configuration. Specifically, the P-channel MOS transistor PM4 is removed from the voltage-decrease circuit, the output ϕ4 is supplied to only the booster 15, and the node of the P-channel MOS transistor PM3, which is connected to the P-channel MOS transistor PM4 in the voltage-decrease circuit, is connected to the terminal Vcc. In the circuit of the second embodiment, when the external power supply voltage Vcc is above a predetermined switching voltage Vsw, the booster 15 does not operate, and the internal voltage Vint becomes equal to the external power supply voltage Vcc. On the other hand, when the external power supply voltage Vcc is below the switching voltage Vsw, the booster 15 operates, and the internal voltage Vint becomes the external power supply voltage Vcc or above. As is shown in the characteristic diagram of FIG. 9, the internal voltage Vint is always above the external power supply voltage Vcc, and the above-mentioned external/internal voltage comparing/selecting circuit 18 is not required.

Figure 10:
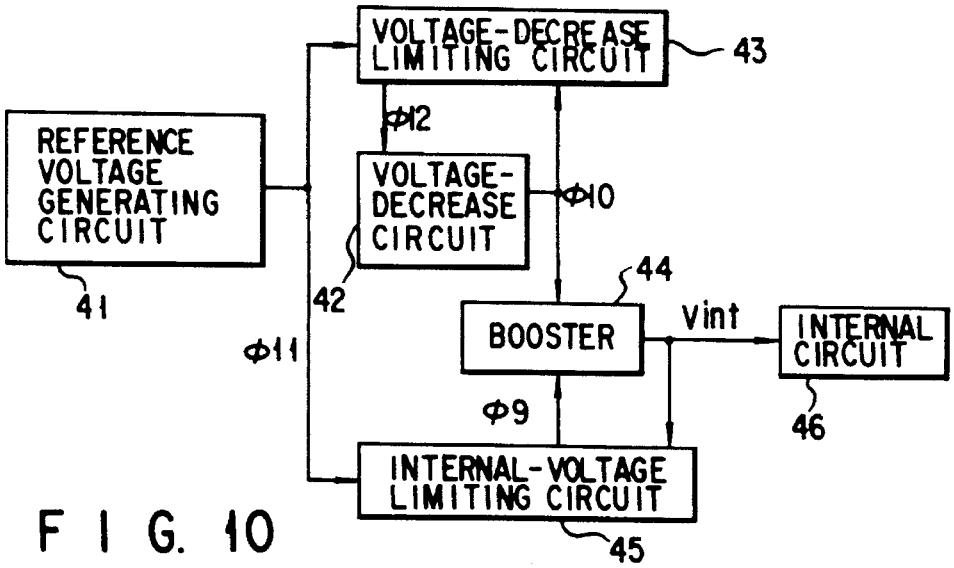
FIG. 10 is a block diagram showing a semiconductor integrated circuit of a third embodiment of the present invention.

FIG. 10 is a block diagram showing a semiconductor integrated circuit according to a third embodiment of the invention. According to the third embodiment, this invention is applied to a semiconductor IC having an internal voltage generating circuit for decreasing the externally supplied power source voltage Vcc and increasing the decreased output to obtain a desired internal voltage.

In FIG. 10, reference numeral 41 denotes a reference voltage generating circuit. A voltage-decrease circuit 42 constantly decreases the external power supply voltage Vcc and produces an output ϕ10. A voltage-decrease limiting circuit 43 is supplied with the output ϕ10 of the voltage-decrease circuit 42 and an output ϕ11 of the reference voltage generating circuit 41, and the limiting circuit 43 supplies an output ϕ12 to the voltage-decrease circuit 42 in order to limit the output ϕ10 to a constant level. A booster 44 constantly boosts the voltage-decreased output ϕ10. An internal-voltage limiting circuit 45 is supplied with the output from the booster 44 and the output ϕ11 of the reference voltage generating circuit 41, and the limiting circuit 45 supplies an output ϕ9 to the booster 44 and thereby limiting the boosting output at a constant level. An internal circuit 46 is supplied with the output from the booster 44 as internal voltage Vint.

The reference voltage generating circuit 41 generates a voltage having low voltage-dependency upon the external power supply voltage Vcc and low temperature-dependency. For example, by using a band-gap reference circuit comprising bipolar transistors or a MOS transistor in which no channel ions are injected, a constant voltage is generated as output ϕ11. The voltage-decrease circuit 42 cooperates with the voltage-decrease limiting circuit 43 to function as feedback type voltage-decrease circuit. The external power supply voltage Vcc is decreased by the voltage-decrease circuit 42 to obtain the output ϕ10 having low dependency upon power supply voltage. The booster 44 comprises a clock generating circuit, a buffer circuit for amplifying the clock generated by the clock generating circuit, and a charge-pump circuit. While controlled by the internal voltage limiting circuit 45, the booster 44 boosts the voltage of output ϕ10.

The internal voltage limiting circuit 45 comprises a voltage converting circuit for converting the internal voltage Vint to a lower level voltage, and a comparing circuit for comparing the level-converted voltage from the voltage converting circuit with the output ϕ11. The operation of the clock generating circuit is controlled so that the internal voltage Vint may have a predetermined value.

The oscillation of the clock generating circuit within the boosting circuit 44 is controlled by the output ϕ9 of the internal voltage limiting circuit 45. The buffer circuit supplies a current high enough to drive the charge-pump circuit and adjusts the timing on an as-needed basis. Further, the charge-pump circuit receives the clock from the buffer circuit and boosts the voltage of the output ϕ10, thereby producing the internal voltage Vint of a higher potential.

The detailed structure of the above embodiment will now be described.

Figure 11:
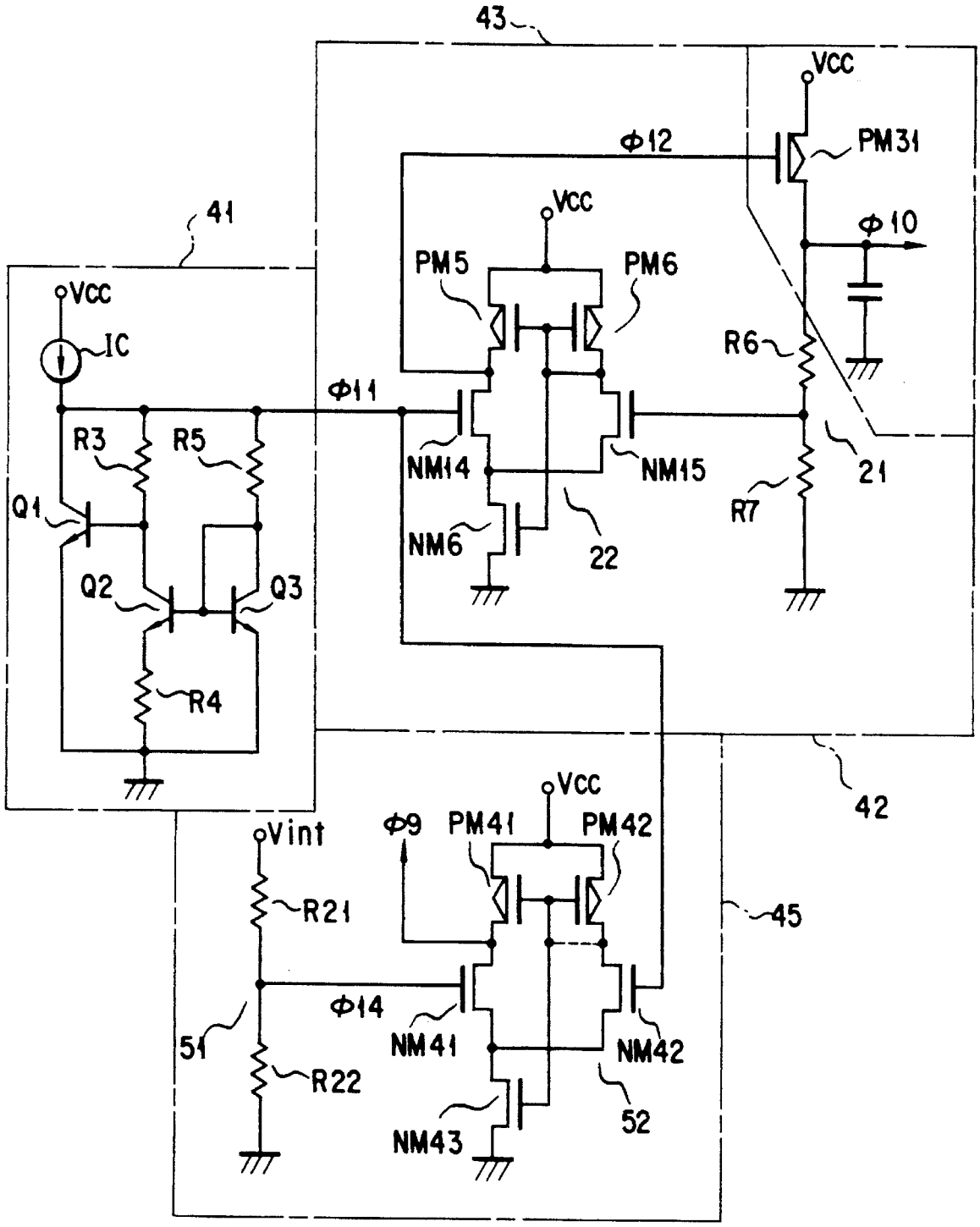
FIG. 11 shows detailed configurations of a reference voltage generating circuit, a voltage-decrease circuit, a voltage-decrease limiting circuit and an internal voltage limiting circuit.

FIG. 11 shows detailed circuit configurations of the reference voltage generating circuit 41 , voltage-decrease circuit 42, voltage-decrease limiting circuit 43, and internal-voltage limiting circuit 45.

The reference voltage generating circuit 41 comprises, like the circuit of FIG. 3, a constant current source IC, bipolar transistors Q1 to Q3, and resistors R3 to R5. The description of FIG. 3 is also applicable to this circuit 41. Specifically, in this circuit, the output ϕ11 having a stable voltage free from temperature dependency is generated.

The voltage-decrease circuit 42 is constituted by a P-channel MOS transistor PM31 having a source-drain passage interposed between the external power supply voltage Vcc and a node for obtaining output ϕ10.

Like the internal voltage limiting circuit 16 shown in FIG.3, the voltage-decrease limiting circuit 43 comprises a voltage converting circuit 21 for dividing voltage and a comparing circuit 22. In this case, however, the voltage converting circuit 21 does not divide the internal voltage Vint but divides a voltage of the output ϕ10 from the voltage-decrease circuit. In addition, the comparing circuit 22 has a CMOS structure to which the output ϕ11 of the reference voltage generating circuit 41 and the output of the voltage converting circuit 21 are input. An output ϕ12 of the comparing circuit ϕ22 is delivered to the gate of the P-channel MOS transistor PM31 within the voltage-decrease circuit 42.

The internal voltage limiting circuit 45 comprises a voltage converting circuit 51 for dividing the internal voltage Vint and a comparing circuit 52. The voltage converting circuit 51 comprises two resistors R21 and R22 inserted between a node for obtaining the internal voltage Vint and the ground potential, and an output ϕ13 can be obtained from a node therebetween. The other comparing circuit 52 comprises P-channel MOS transistors PM41 and PM42 and N-channel MOS transistors NM41, NM42 and NM43. The comparing circuit 52 has a CMOS structure to which the output ϕ14 of the voltage converting circuit 51 and the output ϕ11 of the reference voltage generating circuit 41 are supplied. Thus, the comparing circuit 52 produces the output ϕ9.

Figure 12:
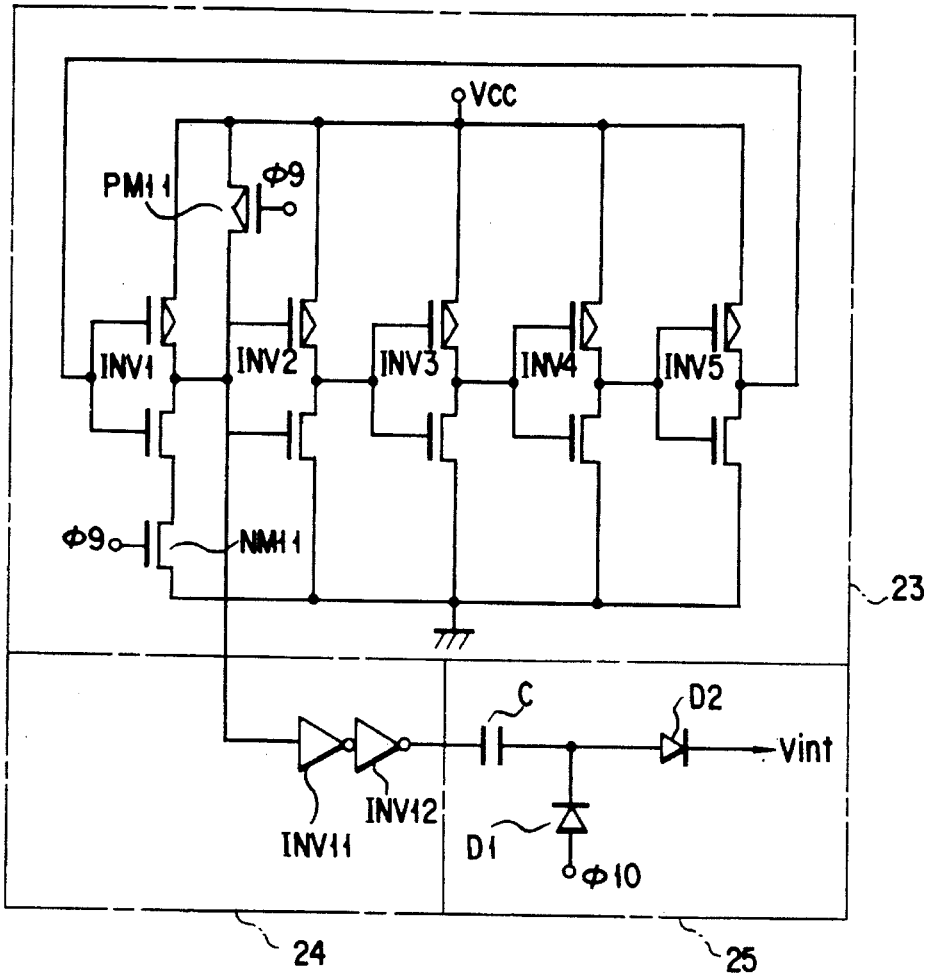
FIG. 12 is a detailed configuration of a booster shown in FIG. 10.

FIG. 12 shows a detailed structure of the booster 44 in the IC of the third embodiment. Like the charge-pump type booster of FIG. 4, the booster 44 comprises a clock generating circuit 23, a buffer circuit 24 and a charge-pump circuit 25. The description of FIG. 4 is applicable, except that single output ϕ9 controls the oscillation function of the clock generating circuit 23. Specifically, in the case of the clock generating circuit 23, P-channel MOS transistors PM11 and N-channel MOS transistor NM11 are provided in addition to five inverters INV1 to INV5. The gates of both MOS transistors PM11 and NM11 are supplied with output $\phi 9$. Regarding the buffer circuit 24 and charge-pump circuit 25, the description of the charge-pump type booster shown in FIG. 4 is applicable. In the charge-pump circuit 25 of FIG. 4, a positive charge is transferred from the external power supply voltage Vcc to the internal voltage Vint. However, in the case of the booster shown in FIG. 12, a positive charge is transferred from the terminal, at which output $\phi 10$ of the voltage-decrease circuit is input, to the terminal Vint. The principle of operation is the same as in the case of FIG. 4.

According to this embodiment, the voltage-decrease circuit 42 and the booster 44 are operated such that when the value of external power supply voltage Vcc is lower than the switching voltage Vsw in FIG. 2, the internal voltage Vint becomes greater than the external power supply voltage Vcc. Furthermore, when the voltage-decrease circuit 42 and booster 44 are operated such that when the value of external power supply voltage Vcc is greater than the switching voltage Vsw, the internal voltage Vint becomes lower than the external power supply voltage Vcc. Thereby, the degree of freedom for setting the internal voltage Vint is increased, and the optimal internal voltage suitable for the characteristics of the IC can be set.

Figure 13A:
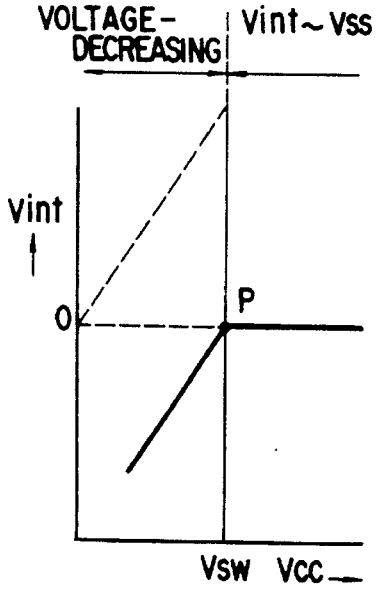
FIGS. 13A and 13B are graphs showing a relation between an outer power source voltage and an internal voltage using a switching voltage.
Figure 13B:
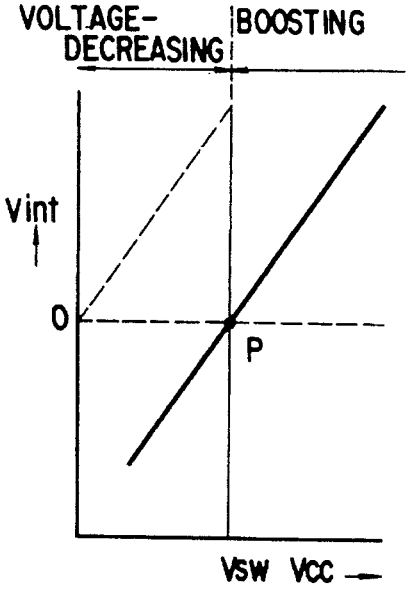

In each of the above embodiments, of the high voltage and low voltage of the external power source, the high voltage is boosted and decreased, thereby producing the internal voltage. Even if the low voltage is boosted and decreased, the same advantage can be obtained. In this case, in each of the above embodiments, the external power supply voltage Vcc is replaced by the ground potential, the ground potential by Vcc, the P-channel MOS transistor by the N-channel MOS transistor, the N-channel MOS transistor by the P-channel MOS transistor, the booster for boosting from Vcc by the voltage-decrease circuit for decreasing from the ground potential, and the voltage-decrease circuit for decreasing from Vcc by the booster for boosting from the ground potential. FIGS. 13A and 13B show characteristics of the internal voltage Vint in this case. In a region where Vcc is lower than point P at which Vint =Vss (ground potential), Vint is decreased to a voltage lower than Vss. In a region where Vcc is higher than point P, Vint is boosted to Vss or a higher voltage.

Figure 14:
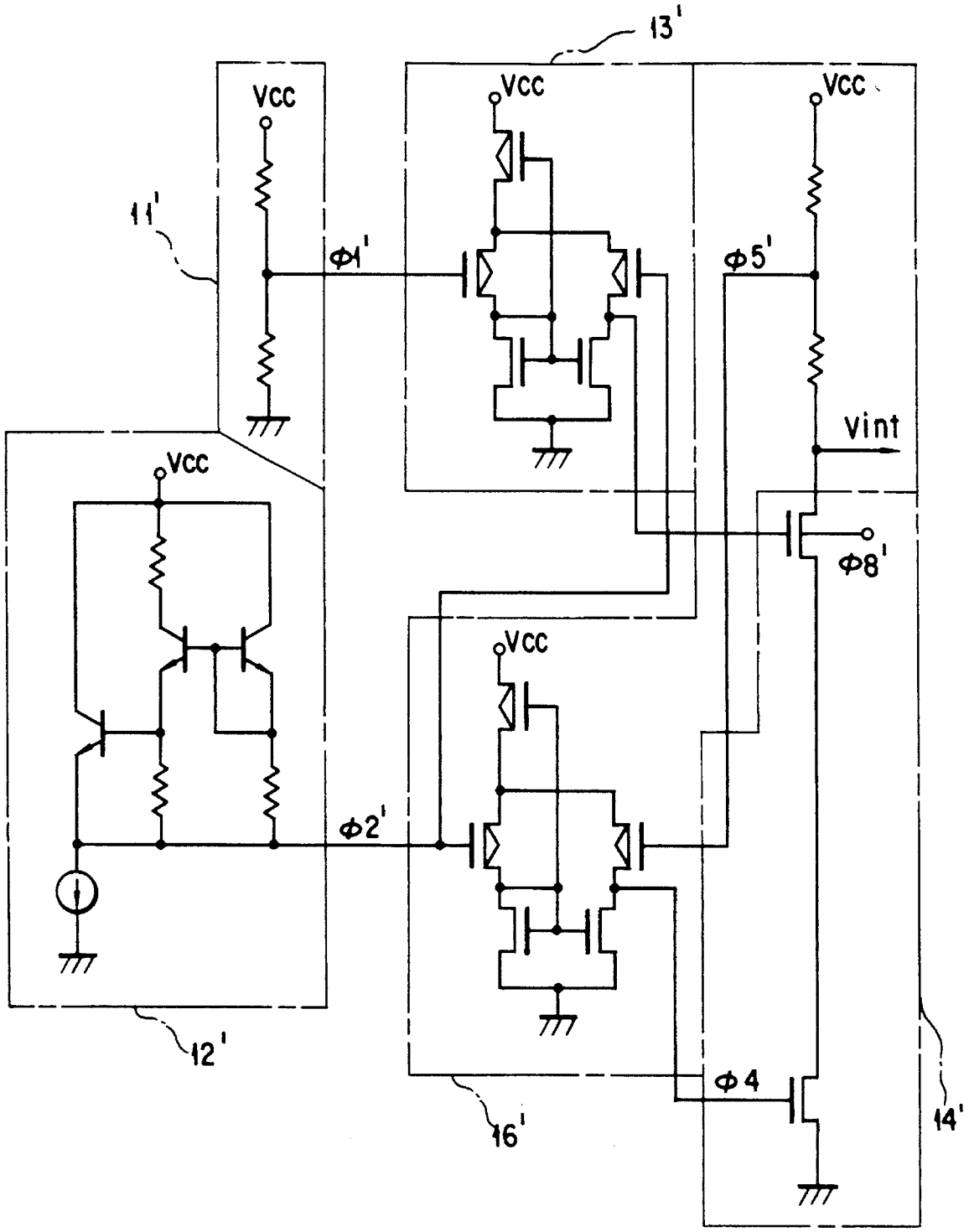
FIG. 14 is a block diagram showing a semiconductor integrated circuit of a fourth embodiment of the present invention.
Figure 15:
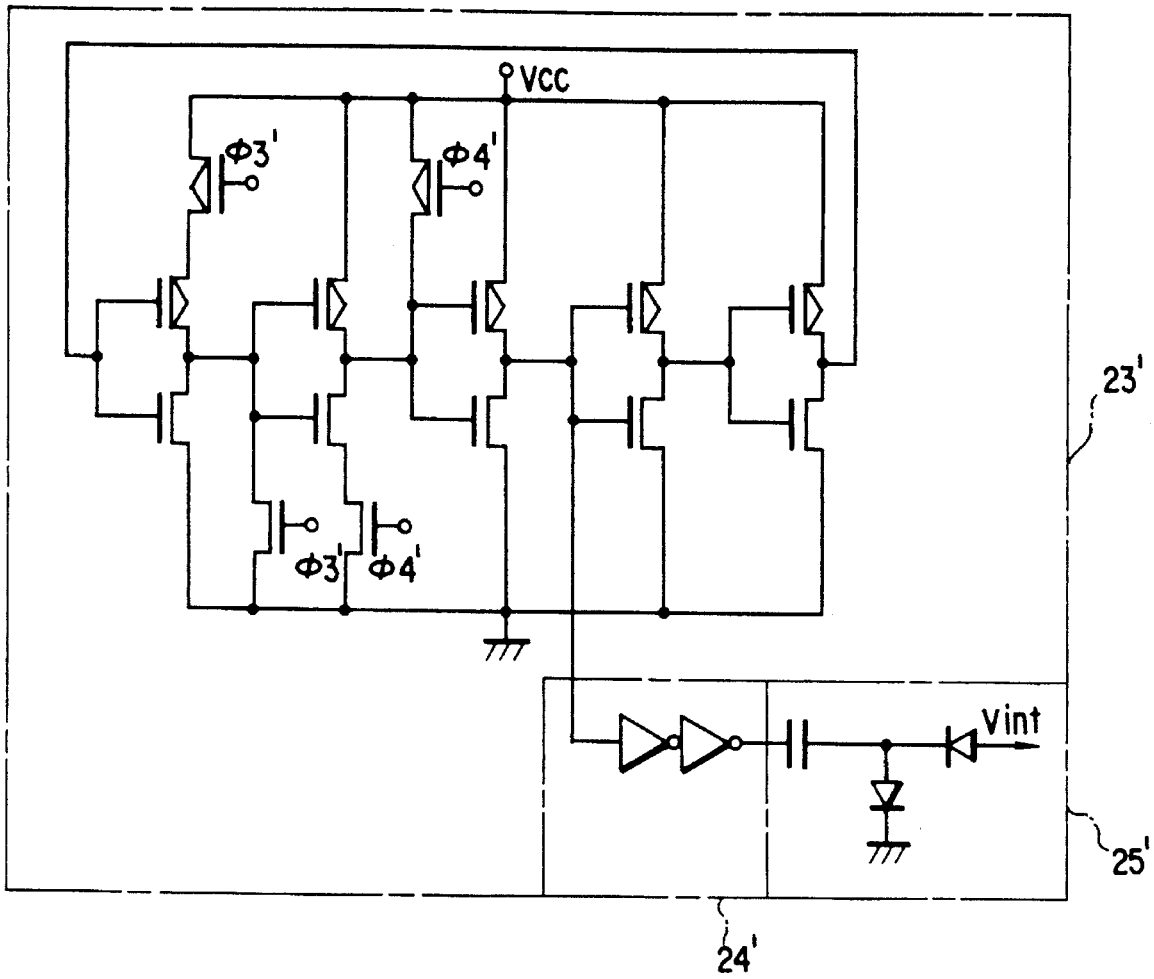
FIG. 15 is a detailed configuration of a booster incorporated in the fourth embodiment of the present invention.
Figure 16:
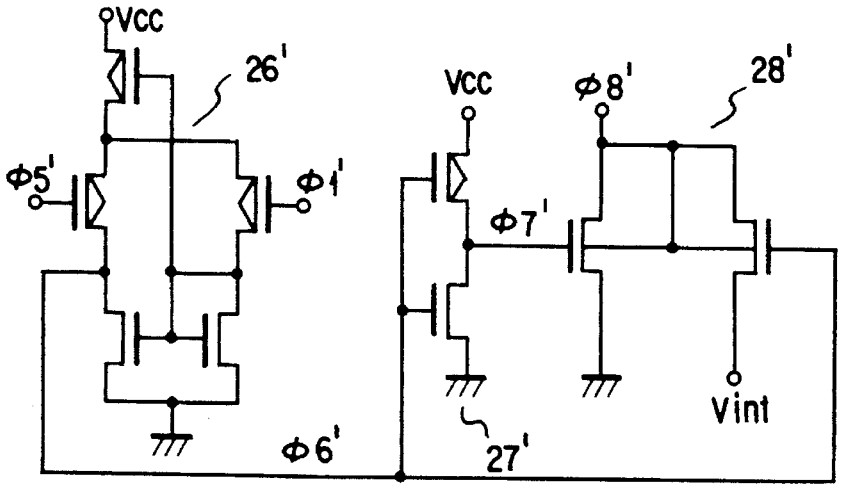
FIG. 16 is a detailed configuration of an external/internal voltage comparing/selecting circuit incorporated in the fourth embodiment of the present invention.

FIGS. 14 to 16 show a fourth embodiment of the invention wherein output characteristics as shown in FIG. 13B are obtained. FIG. 14 shows detailed structures of the circuits corresponding to the voltage converting circuit 11, reference voltage generating circuit 12, voltage-decrease/boosting selecting circuit 13, voltage-decrease circuit 14 and internal voltage limiting circuit 16 of the first embodiment. In FIG. 14, the elements corresponding to those in FIG. 3 are denoted by like reference numerals accompanied with dash marks (′). Similarly, FIG. 15 shows a detailed structure of the circuit corresponding to the booster 15, and FIG. 16 shows a detailed structure of the circuit corresponding to the external/internal voltage comparing/selecting circuit 18. The elements corresponding to those in FIGS. 4 and 5 are denoted by like reference numerals accompanied with dash marks (′). Since these embodiments are modifications of the circuits of FIGS. 3 to 5 based on the above principle, the description of operations may be omitted. Regarding the second and third embodiments, the ground potential of the external power supply may be boosted and decreased by interchanging the high level and low level.

The fourth embodiment is effective in the case of using a DRAM circuit wherein a P-channel type cell transfer transistor is used in the internal circuit supplied with the internal voltage Vint′. The reason is that in order to write a sufficient amount of information in a memory cell with a low external power supply voltage, it is desirable to supply word lines with a potential decreased to the ground voltage Vss or below in a region where the external power supply voltage Vcc is low.

As has been described above, the present invention can provide a semiconductor integrated circuit which is free from limitations of the range of operational power supply voltages or degradation of reliability.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A semiconductor integrated circuit having a function of providing an internal voltage having little dependency on a variation of external power supply voltage, said semiconductor integrated circuit comprising:

reference voltage generating means for generating a reference voltage and for outputting the reference voltage as a first output;

voltage converting means for converting the external power supply voltage to a lower voltage than the external power supply voltage and for outputting the lower voltage as a second output, a level of the second output being changed in accordance with a level of the external power supply voltage;

voltage-decrease/boosting selecting means for receiving the first and second outputs and for comparing a level of the first output with a level of the second output and generating a third output, a level of the third output being selected according to whether the level of the first output exceeds the level of the second output;

voltage-decrease means for receiving the third output and for constantly decreasing the external power supply voltage and outputting the internal voltage when the third output has a first level;

boosting means for receiving the third output and for constantly boosting the external power supply voltage and outputting the internal voltage when the third output has a second level;

internal voltage limiting means for receiving the first output and the internal voltage and for generating a fourth output to control a decreasing amount of said voltage-decrease means and a boosting amount of said boosting means; and an internal circuit for receiving the internal voltage.

2. The integrated circuit according to claim 1, wherein said internal voltage limiting means forms a negative feedback loop and maintains the level of the internal voltage constant when the level of the external power supply voltage changes.

3. A semiconductor integrated circuit having a function of providing an internal voltage having little dependency on a variation of external power supply voltage, said semiconductor integrated circuit comprising:

reference voltage generating means for generating a reference voltage and for outputting the reference voltage as a first output;

voltage decrease means for constantly decreasing the external power supply voltage and generating a second output, wherein said voltage decrease means receives a third output to maintain a level of the second output constant;

voltage-decrease limiting means for receiving the first output and generating the third output;

boosting means for receiving the second output outputted from said voltage-decrease means and for boosting the second output to output the internal voltage;

internal voltage limiting means for receiving the first output and the internal voltage and for outputting a fourth output to said boosting means to maintain a level of boosting of said boosting means constant; and an internal circuit for receiving the internal voltage.

4. The integrated circuit according to claim 3, wherein said voltage-decrease limiting means forms a negative feedback loop and maintains a level of the internal voltage constant when a level of an external power supply voltage changes.

5. A semiconductor integrated circuit for providing an internal voltage substantially independent of variations in an external power supply voltage, said semiconductor integrated circuit comprising:

a reference voltage generating circuit for generating a reference voltage as a first control signal;

a voltage converting circuit for converting the external power supply voltage to a second control signal, the second control signal having a voltage less than the external power supply voltage;

a voltage-decrease/boosting selecting circuit for comparing the first and second control signals and for selectively generating a third control signal at a first level or a second level based on which of the first and second control signals has a higher level;

a voltage-decrease circuit responsive to the third control signal for constantly decreasing the external power supply voltage and generating the internal voltage when the third control signal is at the first level, said voltage-decrease circuit receiving a fourth control signal which controls a decreasing amount;

a boosting circuit responsive to the third control signal for constantly boosting the external power supply voltage and generating the internal voltage when the third control signal is at the second level, said boosting circuit receiving the fourth control signal which controls a boosting amount;

an internal voltage limiting circuit responsive to the first control signal and the internal voltage for generating the fourth control signal to limit the internal voltage; and an internal circuit for receiving the internal voltage.

6. The integrated circuit according to claim 5 wherein the internal voltage limiting circuit forms a negative feedback loop and maintains the level of the internal voltage constant when the level of the external power supply voltage changes.

7. The integrated circuit according to claim 5 further comprising an external/internal voltage comparing/selecting circuit for comparing the first control signal and a fifth control signal from said voltage-decrease circuit and selectively outputting a voltage representative of the larger of the first and fifth control signals to said voltage-decrease circuit and said voltage-decrease/boosting selecting circuit.

8. The integrated circuit according to claim 5 wherein said internal circuit includes a DRAM circuit having a plurality of dynamic memory cells.

9. The integrated circuit according to claim 5 wherein said voltage converting circuit includes a voltage divider circuit.

10. The integrated circuit according to claim 5 wherein said reference voltage generating circuit comprises a band gap reference circuit including bipolar transistors or a MOS transistor in which no channel ions are injected.

11. A semiconductor integrated circuit for providing an internal voltage substantially independent of variations in an external power supply voltage, said semiconductor integrated circuit comprising:

a reference voltage generating circuit for generating a reference voltage as a first control signal;

a voltage decrease circuit for constantly decreasing the external power supply voltage and generating a second control signal, wherein said voltage decrease circuit receives a third control signal;

a voltage-decrease limiting circuit responsive to the first and second control signals for generating the third control signal that limits the second control signal to a constant level;

a boosting circuit responsive to the second control signal and a fourth control signal for boosting the second control signal to output the internal voltage;

an internal voltage limiting circuit responsive to the first control signal and the internal voltage for generating the fourth control signal to maintain a boosting level of said boosting circuit constant; and an internal circuit for receiving the internal voltage.

12. The integrated circuit according to claim 11, wherein said voltage-decrease limiting circuit forms a negative feedback loop and maintains a level of the internal voltage constant when a level of an external power supply voltage changes.

13. The integrated circuit according to claim 11 wherein said internal circuit includes a DRAM circuit having a plurality of dynamic memory cells.

14. The integrated circuit according to claim 3, wherein said reference voltage generating circuit comprises a band gap reference circuit including bipolar transistors or a MOS transistor in which no channel ions are injected.

15. The integrated circuit according to claim 1, wherein said reference voltage generating means includes a reference voltage generating circuit for generating the reference voltage which has a low dependency on the external power supply voltage and low dependency on temperature.

16. The integrated circuit according to claim 15, wherein said reference voltage generating circuit includes a band-gap reference circuit having bipolar transistors or a MOS transistor in which no channel ion are injected.

17. The integrated circuit according to claim 1, wherein said voltage converting means includes a voltage converting circuit for converting the external power supply voltage to the lower voltage.

18. The integrated circuit according to claim 17, wherein said voltage converting circuit includes a divider for dividing the external power supply voltage, said divider including at least two load elements connected between an external power supply and a ground potential, and outputting the lower voltage from a node of the at least two load elements.

19. The integrated circuit according to claim 1, wherein said voltage-decrease/boosting selecting means includes a comparing circuit for comparing the reference voltage with the lower voltage and generating the third output.

20. The integrated circuit according to claim 19, wherein the external power supply voltage is applied to a power supply terminal of the comparing circuit when the external power supply voltage is greater than the internal voltage, and the internal voltage is applied to the power supply terminal of the comparing circuit when the external power supply voltage is less than the internal voltage.

21. The integrated circuit according to claim 1, wherein said voltage-decrease means includes first and second MOS transistors whose current paths are connected in series and inserted between an external power supply and said internal circuit, and a voltage dividing circuit for dividing the internal voltage, the fourth output generated by said internal voltage limiting means being supplied to a gate of said first MOS transistor, and the third output generated by said voltage-decrease/boosting selecting means being supplied to a gate of said second MOS transistor.

22. The integrated circuit according to claim 21, wherein the external power supply voltage is applied to a back gate of said second MOS transistor when the external power supply voltage is greater than the internal voltage, and the internal voltage is applied to the back gate of said second MOS transistor when the external power supply voltage is less than the internal voltage.

23. The integrated circuit according to claim 1, wherein said voltage-decrease means includes first and second MOS transistors whose current paths are connected in series and inserted between a ground potential and said internal circuit, and a voltage dividing circuit for dividing the internal voltage corresponding to a difference between the external power supply voltage and the internal voltage, the fourth output generated by said internal voltage limiting means being supplied to a gate of said first MOS transistor, and the third output generated by said voltage-decrease/boosting selecting means being supplied to a gate of said second MOS transistor.

24. The integrated circuit according to claim 23, wherein the external power supply voltage is applied to a back gate of said second MOS transistor when the external power supply voltage is greater than the internal voltage, and the internal voltage is applied to the back gate of said second MOS transistor when the external power supply voltage is less than the internal voltage.

25. The integrated circuit according to claim 1, wherein said boosting means is a charge pump type booster, said charge pump type booster including a clock generating circuit for generating clock signals, a buffer circuit for receiving the clock signals, and a charge pump circuit for receiving output signals from said buffer circuit.

26. The integrated circuit according to claim 21, wherein said internal voltage limiting means includes a first comparing circuit for comparing the first output with an output of said voltage dividing circuit and for generating the fourth output.

27. The integrated circuit according to claim 23, wherein said internal voltage limiting means includes a first comparing circuit for comparing the first output with an output of said voltage dividing circuit and for generating the fourth output.

28. The integrated circuit according to claim 26, further comprising external/internal voltage comparing/selecting means for comparing the second output of the voltage converting means and the output of said voltage dividing circuit to determine a greater-value output, and for selectively supplying the greater-value output to said voltage-decrease/boosting selecting means and said voltage-decrease means.

29. The integrated circuit according to claim 28, wherein said external/internal voltage comparing/selecting means includes:

a second comparing circuit for comparing the second output of said voltage converting means and the output of said voltage dividing circuit;

an inverter for inverting an output of said second comparing circuit; and a voltage switching circuit for receiving the output of said second comparing circuit and an output of said inverter and for outputting the internal voltage when the second output is greater than the output of said voltage dividing circuit and outputting the external power supply voltage when the second output is less than the output of said voltage dividing circuit.

30. The integrated circuit according to claim 29, wherein said voltage switching circuit includes:

a first MOS transistor having a current path including a first terminal which is supplied with the external power supply voltage and a gate to which the output of the inverter is supplied; and a second MOS transistor having a current path including a first terminal which is supplied with the internal voltage, a second terminal and a back gate both connected to a back gate and a second terminal of said first MOS transistor and forming a common node, and a gate to which the output of said second comparing circuit is supplied, and wherein said voltage switching circuit outputs from said common node the external power supply voltage when the second output is less than the output of said voltage dividing circuit and outputs the internal voltage when the second output is greater than the output of said voltage dividing circuit.

31. The integrated circuit according to claim 27, further comprising external/internal voltage comparing/selecting means for comparing the second output of the voltage converting means and the output of said voltage dividing circuit to determine a greater-value output, and for selectively supplying the greater-value output to said voltage-decrease/boosting selecting means and said voltage-decrease means.

32. The integrated circuit according to claim 31, wherein said external/internal voltage comparing/selecting means includes:

a second comparing circuit for comparing the second output of the voltage converting means and the output of said voltage dividing circuit;

an inverter for inverting an output of said second comparing circuit; and a voltage switching circuit for receiving the output of said second comparing circuit and an output of said inverter and for outputting the internal voltage when the second output is less than the output of said voltage dividing circuit and outputting a ground potential when the second output is greater than the output of said voltage dividing circuit.

33. The integrated circuit according to claim 32, wherein said switching circuit includes:

a first MOS transistor having a current path including a first terminal which is grounded and a gate to which the output of said inverter is supplied; and a second MOS transistor having a current path including a first terminal which is applied with the internal voltage, a second terminal and a back gate both connected to a back gate and a second terminal of said first MOS transistor and forming a common node, and a gate to which the output of said comparing circuit is supplied, wherein said voltage switching circuit outputs from said common node the ground potential when the second output is greater than the output of said voltage dividing circuit and outputs the internal voltage when the second output is less than the output of said voltage dividing circuit.

34. The integrated circuit according to claim 21, wherein said voltage-decrease/boosting selecting means includes:

a comparing circuit for comparing the first output with the second output; and a level shifter for shifting an output level of said comparing circuit to a level of the external power supply voltage when the second output is less than the first output and for shifting the output level of said comparing circuit to a level of the internal voltage when the second output is greater than the second output of the voltage converting means.

35. The integrated circuit according to claim 1, wherein said voltage-decrease/boosting selecting means includes:

a first comparing circuit for comparing the first output with the second output;

an inverter for inverting an output of said first comparing circuit; and a second comparing circuit supplied with the output of said first comparing circuit and an output of said inverter, for generating the third output.

36. The integrated circuit according to claim 1, wherein said internal circuit includes a DRAM circuit having a plurality of dynamic memory cells.

37. A semiconductor integrated circuit having a function of providing an internal voltage having little dependency on a variation of external power supply voltage, said semiconductor integrated circuit comprising:

reference voltage generating means for generating a reference voltage and for outputting the reference voltage as a first output;

voltage convening means for convening the external power supply voltage to a lower voltage than the external power supply voltage and for outputting the lower voltage as a second output, a level of the second output being changed in accordance with a level of the external power supply voltage;

boosting selecting means for receiving the first and second outputs and for comparing a level of the first output with a level of the second output and generating a third output, a level of the third output being selected according to whether the level of the first output exceeds the level of the second output;

boosting means for receiving the third output and for boosting the external power supply voltage and outputting the internal voltage when the third output has a second level;

internal voltage limiting means for receiving the first output and the internal voltage and for generating a fourth output to control a boosting amount of said boosting means; and an internal circuit for receiving the internal voltage.

38. The integrated circuit according to claim 37, wherein said internal voltage limiting means forms a negative feedback loop and maintains the level of the internal voltage constant when the level of the external power supply voltage changes.

39. The integrated circuit according to claim 37, wherein said reference voltage generating means includes a reference voltage generating circuit for generating a voltage which has low dependency on the external power supply voltage and low dependency on temperature.

40. The integrated circuit according to claim 39, wherein said reference voltage generating circuit includes a band-gap reference circuit having bipolar transistors or a MOS transistor in which no channel ions are injected.

41. The integrated circuit according to claim 37, wherein said voltage converting means includes a voltage converting circuit for converting the external power supply voltage to the lower voltage.

42. The integrated circuit according to claim 41, wherein said voltage converting circuit includes a divider for dividing the external power supply voltage, said divider including at least two load elements connected between an external power supply and a ground potential, and said voltage converting circuit outputting the lower voltage from a node of the at least two load elements.

43. The integrated circuit according to claim 37, wherein said boosting selecting means includes a comparing circuit for comparing the reference voltage with the lower voltage and generating the third output.

44. The integrated circuit according to claim 43, wherein the external power supply voltage is applied to a power supply terminal of said comparing circuit when the external power supply voltage is greater than the internal voltage, and the internal voltage is applied to the power supply terminal of said comparing circuit when the external power supply voltage is less than the internal voltage.

45. The integrated circuit according to claim 37, wherein said voltage-decrease means includes a voltage dividing circuit for dividing the internal voltage, and a MOS transistor whose current path is connected between an external power supply and said internal circuit, the third output being supplied to a gate of said MOS transistor.

46. The integrated circuit according to claim 45, wherein the external power supply voltage is applied to a back gate of said MOS transistor when the external power supply voltage is greater than the internal voltage, and the internal voltage is applied to the back gate of said MOS transistor when the external power supply voltage is less than the internal voltage.

47. The integrated circuit according to claim 37, wherein said voltage-decrease means includes a voltage dividing circuit for dividing a voltage corresponding to a difference between the external power supply voltage and the internal voltage, and a MOS transistor whose current path is connected between a ground potential and said internal circuit, the third output generated by said boosting selecting means being supplied to a gate of said MOS transistor.

48. The integrated circuit according to claim 47, wherein the external power supply voltage is applied to a back gate of said MOS transistor when the external power supply voltage is less than the internal voltage, and the internal voltage is applied to the back gate of said MOS transistor when the external power supply voltage is greater than the internal voltage.

49. The integrated circuit according to claim 37, wherein said boosting means is a charge pump type booster, said charge pump type booster including a clock generating circuit for generating clock signals, a buffer circuit for receiving the clock signals, and a charge pump circuit for receiving output signals from said buffer circuit.

50. The integrated circuit according to claim 45, wherein said internal voltage limiting means includes a comparing circuit for comparing the first output with the output of said voltage dividing circuit and for generating the fourth output.

51. The integrated circuit according to claim 47, wherein said internal voltage limiting means includes a comparing circuit for comparing the first output with the output of said voltage dividing circuit and for generating the fourth output.

52. The integrated circuit according to claim 45, wherein said boosting selecting means includes:

a comparing circuit for comparing the first output with the second output; and a level shifter for generating the third output by shifting an output level of said comparing circuit to a level of the external power supply voltage when the second out is less than the output of said voltage dividing circuit and by shifting the output level of said comparing circuit to a level of the internal voltage when the second output is greater than the output of said voltage dividing circuit.

53. The integrated circuit according to claim 37, wherein said boosting selecting means includes:

a first comparing circuit for comparing the first output with the second output;

an inverter for inverting an output of said first comparing circuit; and a second comparing circuit, supplied with the output of said first comparing circuit and an output of said inverter, for generating the third output.

54. The integrated circuit according to claim 47, wherein said boosting selecting means includes:

a comparing circuit for comparing the first output with the second output of said voltage converting means; and a level shifter for generating the third output by shifting an output level of said comparing circuit to a level of the external power supply voltage when the second output is greater than the output of said voltage dividing circuit and by shifting the output level of said comparing circuit to a level of the internal voltage when the second output is less than the output of said voltage dividing circuit.

55. The integrated circuit according to claim 37, wherein said internal circular includes a DRAM circuit having a plurality of dynamic memory cells.

56. A semiconductor integrated circuit for providing an internal voltage substantially independent of various in an external power supply voltage, said integrated circuit comprising:

a reference voltage generating circuit for generating a reference voltage as a first control signal;

a voltage converting circuit for converting the external power supply voltage to a second control signal, the second control signal having a voltage less than the external power supply voltage;

a boosting selecting circuit for comparing the first and second control signals and for selectively generating a third control signal, a level of the third control signal being selected according to whether the level of the first output exceeds the level of the second output;

a boosting circuit, responsive to the third control signal, for constantly boosting the external power supply voltage and generating the internal voltage when the third control signal is at the second level, said boosting circuit receiving a fourth control signal which controls a boosting amount;

an internal voltage limiting circuit, responsive to the first control signal and the internal voltage, for generating the fourth control to limit the internal voltage; and an internal circuit for receiving the internal voltage.

57. The integrated circuit according to claim 56, wherein the internal voltage limiting circuit forms a negative feedback loop and maintains the level of the internal voltage constant when the level of the external power supply voltage changes.

58. The integrated circuit according to claim 3, wherein said reference voltage generating means includes a reference voltage generating circuit for generating a voltage which has low dependency on the external power supply voltage and low dependency on temperature.

59. The integrated circuit according to claim 58, wherein said reference voltage generating circuit includes a band-gap reference circuit having biopolar transistors or a MOS transistor in which no channel ions are injected.

60. The integrated circuit according to claim 3, wherein said voltage-decrease means includes a MOS transistor whose current path is connected between an external power supply and the second output, the third output generated by said voltage-decrease limiting means being supplied to a gate of said MOS transistor.

61. The integrated circuit according to claim 60, wherein said voltage-decrease limiting means includes a voltage dividing the second output, and a comparing circuit for comparing the first output with an output of said voltage dividing circuit and for generating the third output.

62. The integrated circuit according to claim 3, wherein said internal voltage limiting means includes a voltage dividing circuit for dividing the internal voltage and a comparing circuit for comparing the first output with an output of said voltage dividing circuit and for generating the fourth output.

63. The integrated circuit according to claim 63, wherein said voltage dividing circuit is a divider provided between said internal circuit and a ground potential.

64. A semiconductor integrated circuit having a function of providing an internal voltage having little dependency on a variation of external power supply voltage, said semiconductor integrated circuit comprising:

reference voltage generating means for generating a reference voltage and for outputting the reference voltage as a first output;

voltage converting means for converting the external power supply voltage to a lower voltage than the external power supply voltage and for outputting the lower as a second output, a level of the second output being changed in accordance with a level of the external power supply voltage;

voltage-decrease/boosting selecting means for receiving the first and second outputs and for comparing a level of the first output with a level of the second output and generating a third output, a level of the third output being selected according to whether the level of the first output exceeds the level of the second output;

voltage-decrease means for receiving the third output and for constantly decreasing the external power supply voltage and outputting the internal when the third output has a first level, said voltage-decrease means including first and second NMOS transistor;

an internal circuit for receiving the internal voltage from one end of a current path obtained by connecting current paths of said first and second MOS transistors, wherein said first and second MOS transistors are connected in series between an external power supply and said internal circuit, a fourth output supplied to a gate of said first MOS transistor, the third output being supplied to a gate of said second MOS transistor, and back gate of the second MOS transistor being supplied with the external power supply voltage when the external power supply voltage is greater than the internal voltage and being supplied with the internal voltage when the external power supply voltage is less than the internal voltage;

boosting means for receiving the third output and for boosting the external power supply voltage and outputting the internal voltage when the third output has a second level; and internal voltage limiting means for receiving the first output and the internal voltage and for generating a fourth output to control a decreasing amount of said voltage-decrease and a boosting amount of said boosting means.

65. A semiconductor integrated circuit having a function of providing an internal voltage having little dependency on a variation of external power supply voltage, said semiconductor integrated circuit comprising:

reference voltage generating means for generating a reference voltage and for outputting the reference voltage as a first output;

voltage converting means for converting an external power supply voltage to a lower voltage than the external power supply voltage and for outputting the lower voltage as a second output, a level of the second output being changed in accordance with a level of the external power supply voltage;

boosting selecting means for receiving the first and second outputs and for comparing a level of the first output with a level of the second output and generating a third output, a level of the third output being selected according to whether the level of the first output exceeds the level of the second output;

boosting means for receiving the third output and for boosting the external power supply voltage and outputting an internal voltage when the third output has a second level;

internal voltage limiting means for receiving the first output and the internal voltage and for generating a fourth output to control a boosting amount of said means, said internal voltage limiting means including a MOS transistor having a current path, a first terminal of which is connected to an external power supply, a gate to which the third output of said voltage-decrease/boosting selecting means is supplied, and a back gate applied with the external power supply voltage when the external power supply voltage is greater than the internal voltage and with the internal voltage when the external power supply voltage is less than the internal voltage; and an internal circuit for receiving for the internal voltage from a second terminal of said MOS transistor.

66. A semiconductor integrated circuit having a function of providing an internal voltage having little dependency on a variation of external power supply voltage, said semiconductor integrated circuit comprising:

reference voltage generating means for generating a reference voltage and for outputting the reference voltage as a first output;

voltage-decrease means for constantly decreasing the external power supply voltage and generating a second output, wherein said voltage-decrease means receives a third output to maintain a level of the second output constant, said voltage-decrease means including a MOS transistor having a current path including a first terminal connected to an external power supply, a gate to which the third output is applied, and a back gate applied with the external power supply voltage when the external power supply voltage is greater than the internal voltage and with in the internal voltage when the external power supply voltage is less than the internal voltage;

voltage-decrease limiting means for receiving the first output and the second output and for outputting the third output to said voltage-decrease means;

boosting means for receiving the second output outputted from said voltage-decrease means and for boosting the second output to output the internal voltage;

internal voltage limiting means for receiving the first output and the internal voltage and for outputting a fourth output to said boosting means to maintain a level of the boosting means constant; and an internal circuit for receiving the internal voltage from a second terminal of said MOS transistor.

67. A semiconductor integrated circuit having a function of providing an internal voltage having little dependency on a variation of external power supply voltage, said semiconductor integrated circuit comprising:

reference voltage generating means for generating a reference voltage and for outputting the reference voltage as a first output;

voltage converting means for converting the external power supply voltage to a lower voltage than the external power supply voltage and for outputting the lower voltage as a second output, a level of the second output being changed in accordance with a level of the external power of supply voltage;

voltage-decrease/boosting selecting means for receiving the first and second outputs and for comparing a level of the first output with a level of the second output and generating a third output, a level of the third output being selected according to whether the level of the first output exceeds the level of the second output;

boosting means for receiving the third output and for boosting the external power supply voltage when the third output has a second level;

internal voltage limiting means for receiving the first output and the internal voltage and for generating a fourth output to control a decreasing amount of said voltage-decrease means and a boosting amount of said boosting means;

voltage-decrease means for receiving the third output and for constantly decreasing the external power supply voltage and outputting the internal voltage when the third output has a first level, said voltage-decrease means including first and second MOS transistors, the fourth output being to a gate of said first MOS transistor, the third output being supplied to a gate of said second MOS transistor, and a back gate of said second MOS transistor being supplied with the external power supply voltage when the external power supply voltage is greater than the internal voltage, and being supplied with the internal voltage when the external power supply voltage is less than the internal voltage; and an internal circuit for receiving the internal voltage from one end of a current path obtained by connecting current paths of said first and second MOS transistors connected in series between a ground potential and said internal circuit.

68. A semiconductor integrated circuit having a function of providing an internal voltage having little dependency on a variation in an external power supply voltage, said semiconductor integrated circuit comprising:

comparing means for comparing the external power supply voltage and a reference voltage, and for outputting a first-level signal when the external power supply voltage is greater than or equal to the reference and outputting a second-level signal when the external power supply voltage is less than the reference voltage;

voltage-decrease means for decreasing the external power supply in response to the first-level signal output;

boosting means for boosting the external power supply voltage in response to the second-level signal output; and an internal circuit to which a voltage output from said voltage-decrease means is supplied as the internal voltage when the external power supply voltage is greater than or equal to the reference voltage, and to which a voltage output from the boosting means is supplied as the internal voltage when the external power supply voltage is less than the reference voltage.

69. The integrated circuit according to claim 68, wherein said comparing means includes:

reference voltage generating means for generating the reference voltage and for outputting the reference voltage as a first output;

voltage converting means for converting the external power supply voltage to a lower voltage than the external power supply voltage and for outputting the lower voltage as a second output, a level of the second output being changed in accordance with a level of the external power supply voltage; and voltage-decrease/boosting selecting means for receiving the first and second outputs and for comparing a level of the first output with a level of the second and generating a third output, a level of the third output being selected according to whether the level of the first output exceeds the level of the second output.

70. The integrated circuit according to claim 68, wherein said comparing means includes:

a reference voltage circuit for generating the reference voltage as a first output;

a voltage converting circuit for converting the external power supply voltage to a second output, the second output having a voltage less than the external power supply voltage; and a voltage-decrease/boosting selecting circuit for comparing the first and second outputs and for selectively generating a third output, a level of the third output selected according to whether the level of the first output exceeds the level of the second output.

71. A semiconductor integrated circuit having a function of providing an internal voltage having little dependency on a variation in an external power supply voltage, said semiconductor integrated circuit comprising:

boosting means for the external power supply voltage;

switching means for comparing the external power supply with a reference voltage, and for outputting the internal voltage, the internal voltage being the external power supply voltage when the external power supply voltage is greater than the reference voltage and the internal voltage being an output voltage of said boosting means when the external power supply is less than the reference voltage; and an internal circuit which is applied with the internal voltage.

72. The integrated circuit according to claim 71, wherein said switching means includes:

reference voltage generating means for generating the reference voltage and for outputting the reference voltage as a first output;

voltage converting means for converting the external power supply voltage to a lower voltage than the external power supply voltage and for outputting the lower voltage as a second output, a level of the second output being changed in accordance with a level of the external power supply voltage; and boosting selecting means for receiving the first and second outputs and for comparing a level of the first output with a level of the second output and generating a third output, a level of the third output being selected according to whether the level of the first output exceeds the level of the second output.

73. The integrated circuit according to claim 71, wherein said switching means includes:

a reference voltage generating circuit for generating the reference voltage as a first control signal;

a voltage converting circuit for converting the external power supply voltage to a second control signal, the second control having a voltage less than the external power supply voltage; and a boosting selecting circuit for comparing the first and second control signals and for selectively generating a third control signal, a level of the third control signal being selected according to whether the level of the first control signal exceeds the level of the second control signal.

74. A semiconductor integrated circuit having a function of providing an internal voltage having little dependency on a variation in an external power supply voltage, said semiconductor integrated circuit comprising:

voltage-decrease means for generating the external power supply voltage;

boosting means for boosting an output voltage of said voltage-decrease means and outputting the internal voltage; and an internal circuit applied with internal voltage from said boosting means.

75. The integrated circuit according to claim 74, further comprising:

reference voltage generating for generating the reference voltage and for outputting the reference voltage as a first output;

voltage-decrease limiting means for receiving the first output and a second output of said voltage-decrease means and for outputting a third output to said voltage-decrease means; and internal voltage limiting means for receiving the first output and the internal voltage and for outputting a fourth output to said boosting means to maintain the level of said boosting means constant.

76. The integrated circuit according to claim 74, further comprising:

a reference voltage generating circuit for generating the reference voltage as a first control signal;

a voltage-decrease circuit for constantly decreasing an external power supply voltage and generating a third control signal that limits a second control signal to a constant level; and an internal voltage limiting circuit, responsive to the first control signal and the internal voltage, for generating a fourth control signal to limit the internal voltage.

* * * * *